US009687955B2

(12) United States Patent
Watanabe et al.

(10) Patent No.: US 9,687,955 B2
(45) Date of Patent: Jun. 27, 2017

(54) POLISHING APPARATUS

(75) Inventors: Katsuhide Watanabe, Tokyo (JP); Masakazu Ihara, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 360 days.

(21) Appl. No.: 13/227,804

(22) Filed: Sep. 8, 2011

(65) Prior Publication Data

US 2012/0064800 A1 Mar. 15, 2012

(30) Foreign Application Priority Data

Sep. 9, 2010 (JP) ..... 2010-202156

(51) Int. Cl.

| | |
|---|---|
| ***B24B 49/10*** | (2006.01) |
| ***B24B 37/005*** | (2012.01) |
| ***B24B 37/10*** | (2012.01) |
| ***B24B 49/16*** | (2006.01) |
| ***B24B 49/18*** | (2006.01) |

(52) U.S. Cl.

CPC ..... *B24B 37/005* (2013.01); *B24B 37/107* (2013.01); *B24B 49/16* (2013.01); *B24B 49/18* (2013.01)

(58) Field of Classification Search

CPC ..... B24B 37/005; B24B 37/107; B24B 49/16; B24B 49/18

USPC ..... 451/388, 398, 5

See application file for complete search history.

(56) References Cited

U.S. PATENT DOCUMENTS 5,733,176 A * 3/1998 Robinson et al. ..... 451/41
5,738,574 A * 4/1998 Tolles et al. ..... 451/288
5,948,700 A * 9/1999 Zheng ..... H01L 21/31053 216/86
6,136,043 A * 10/2000 Robinson et al. ..... 8/485
6,283,828 B1 * 9/2001 Numoto ..... 451/8
6,416,617 B2 * 7/2002 Yoshida ..... B24B 37/04 156/345.13
6,702,646 B1 * 3/2004 Gitis et al. ..... 451/5
6,931,330 B1 * 8/2005 Yi et al. ..... 702/41

(Continued)

FOREIGN PATENT DOCUMENTS

JP 2002-355748 12/2002
JP 2004-025413 1/2004

(Continued)

OTHER PUBLICATIONS

Extended European Search Report issued May 9, 2014 in corresponding European Application No. 11007355.8.

*Primary Examiner* — Joseph J Hail
*Assistant Examiner* — Joel Crandall
(74) *Attorney, Agent, or Firm* — Wenderoth, Lind & Ponack, L.L.P.

(57) ABSTRACT

A polishing apparatus includes a table rotating motor configured to rotate a polishing table about its own axis, a top ring rotating motor configured to rotate a top ring about its own axis, a dresser configured to dress a polishing pad, and a pad-height measuring device configured to measure a height of the polishing pad. The polishing apparatus also includes a diagnostic device configured to calculate an amount of wear of the polishing pad from the height of the polishing pad and to determine the end of a life of the polishing pad based on the amount of the wear of the polishing pad, the torque or current of the table rotating motor, and the torque or current of the top ring rotating motor.

28 Claims, 19 Drawing Sheets

(56) References Cited

U.S. PATENT DOCUMENTS

| | | | | |
|---|---|---|---|---|
| 7,040,958 | B2 * | 5/2006 | Gan et al. | 451/8 |
| 8,083,571 | B2 * | 12/2011 | Nabeya et al. | 451/9 |
| 8,096,852 | B2 * | 1/2012 | Deshpande et al. | 451/5 |
| 2002/0037681 | A1 * | 3/2002 | Gitis et al. | 451/5 |
| 2004/0110381 | A1 * | 6/2004 | Yoshida | 438/692 |
| 2005/0070209 | A1 * | 3/2005 | Marxsen et al. | 451/5 |
| 2006/0228991 | A1 * | 10/2006 | Kitajima et al. | 451/5 |
| 2007/0049166 | A1 * | 3/2007 | Yamaguchi et al. | 451/5 |
| 2007/0281592 | A1 * | 12/2007 | Benner | 451/72 |
| 2008/0071414 | A1 * | 3/2008 | Fujita | B24B 37/013 700/121 |
| 2008/0254714 | A1 * | 10/2008 | Torikoshi | 451/5 |
| 2008/0287043 | A1 | 11/2008 | Saito et al. | |
| 2009/0111358 | A1 * | 4/2009 | Nakao et al. | 451/5 |
| 2009/0137190 | A1 * | 5/2009 | Togawa et al. | 451/8 |
| 2009/0191797 | A1 * | 7/2009 | Nabeya et al. | 451/54 |
| 2009/0318060 | A1 * | 12/2009 | Dhandapani et al. | 451/5 |
| 2010/0035518 | A1 * | 2/2010 | Chang et al. | 451/6 |
| 2010/0035525 | A1 | 2/2010 | Deshpande et al. | |
| 2013/0122783 | A1 * | 5/2013 | Menk et al. | 451/11 |

FOREIGN PATENT DOCUMENTS

| | | |
|---|---|---|
| JP | 2006-043857 | 2/2006 |
| JP | 2007-524518 | 8/2007 |
| JP | 2010-226007 | 10/2010 |
| KR | 10-2009-0055494 | 6/2009 |
| TW | 200716298 | 5/2007 |

* cited by examiner

POLISHING APPARATUS

BACKGROUND OF THE INVENTION

Field of the Invention

The present invention relates to a polishing apparatus for polishing a substrate, such as a wafer, and more particularly to a polishing apparatus having a function to diagnose a condition of a polishing pad or a dresser to determine the end of its life.

Description of the Related Art

In fabrication of semiconductor devices, planarizing a surface of a substrate is a very important process. A typically used technique for the surface planarization is chemical mechanical polishing (CMP). In this chemical mechanical polishing, the surface of the substrate is polished by bringing the substrate into sliding contact with a polishing surface of a polishing pad, while supplying a polishing liquid that contains abrasive grains, e.g., silica ($SiO_2$), onto the polishing surface.

This chemical mechanical polishing is conducted using a CMP apparatus. This CMP apparatus has a polishing table for supporting the polishing pad and a top ring for holding the substrate. The polishing pad is attached to an upper surface of the polishing table. During polishing of the substrate, the polishing table and the top ring are rotated about their own axes, and the top ring presses the substrate against the polishing surface of the polishing pad to thereby provide sliding contact between the substrate and the polishing pad. The polishing liquid is supplied onto the polishing surface of the polishing pad, so that the substrate is polished in the presence of the polishing liquid between the substrate and the polishing pad. The substrate surface is planarized by a combination of a chemical polishing action of alkali and a mechanical polishing action of the abrasive grains.

As polishing of the substrate is performed, the abrasive grains and polishing debris adhere to the polishing surface of the polishing pad, lowering a polishing performance thereof. Thus, in order to regenerate the polishing surface of the polishing pad, pad dressing is performed by a dresser. This dresser has hard abrasive grains, such as diamond particles, fixed to a lower surface thereof and is configured to scrape away the polishing surface of the polishing pad to thereby regenerate the polishing surface.

The polishing pad is worn down gradually by the pad dressing. Since the worn polishing pad cannot exhibit its intended polishing performance, it is necessary to replace the polishing pad regularly. Conventionally, the replacement of the polishing pad is typically determined based on the number of substrates polished. However, the number of substrates polished does not necessarily reflect an accurate end point of the life of the polishing pad. For this reason, it is necessary to replace the polishing pad before the end of its service life in order to maintain the polishing performance. Moreover, such frequent replacement of the polishing pad would result in a low operating rate of the CMP apparatus.

For the purpose of avoiding such frequent replacement of the polishing pad, it has been developed a polishing apparatus configured to measure a surface position of the polishing pad (i.e., a pad height) and to monitor wear of the polishing pad based on the measured values (for example, see Japanese laid-open patent publication No. 2002-355748). This type of polishing apparatus can determine the end of the life of the polishing pad based on the measured surface position of the polishing pad, i.e., an amount of wear of the polishing pad.

However, individual polishing pads may have different thicknesses and may have grooves with different depths formed on the surface thereof. As a result, it has been difficult to accurately determine the end point of the life of the polishing pad from the surface position of the polishing pad.

The abrasive grains of the dressers are also worn down gradually by pad dressing. The lowered dressing performance can lower the polishing performance of the polishing pad. Therefore, it is necessary to replace the dresser regularly, as well as the polishing pad. The polishing pad and the dresser are consumables of the polishing apparatus, as described above, and there has recently been an increasing need to minimize costs of these consumables. In order to achieve the cost reduction of the consumables, it is necessary to accurately determine the replacement times of the polishing pad and the dresser, i.e., the lives of these consumables.

SUMMARY OF THE INVENTION

The present invention has been made in view of the above drawbacks. It is therefore a first object of the present invention to provide a polishing apparatus capable of determining the end of the life of the polishing pad accurately and reducing the frequency of the replacement of the polishing pad.

It is a second object of the present invention to provide a polishing apparatus capable of determining the end of the life of the dresser accurately and reducing the frequency of the replacement of the dresser.

One aspect of the present invention for achieving the first object is to provide a polishing apparatus including: a polishing table for supporting a polishing pad; a top ring configured to press a substrate against a polishing surface of the polishing pad; a table rotating motor configured to rotate the polishing table about its own axis; a top ring rotating motor configured to rotate the top ring about its own axis; a dresser configured to dress the polishing surface of the polishing pad; a pad-height measuring device configured to measure a height of the polishing pad; and a diagnostic device configured to monitor the height of the polishing pad, a torque or current of the table rotating motor, and a torque or current of the top ring rotating motor. The diagnostic device is configured to calculate an amount of wear of the polishing pad from the height of the polishing pad and to diagnose a condition of the polishing surface of the polishing pad based on the amount of the wear of the polishing pad, the torque or current of the table rotating motor, and the torque or current of the top ring rotating motor.

One aspect of the present invention for achieving the second object is to a polishing apparatus including: a polishing table for supporting a polishing pad; a top ring configured to press a substrate against a polishing surface of the polishing pad; a table rotating motor configured to rotate the polishing table about its own axis; a top ring rotating motor configured to rotate the top ring about its own axis; a dresser configured to dress the polishing surface of the polishing pad; a pad-height measuring device configured to measure a height of the polishing pad; and a diagnostic device configured to monitor the height of the polishing pad, a torque or current of the table rotating motor, and a torque or current of the top ring rotating motor. The diagnostic device is configured to calculate an amount of wear of the polishing pad from the height of the polishing pad, to calculate a cut rate of the polishing pad from the amount of wear of the polishing pad and a total dressing time per predetermined number of substrates, and to diagnose a condition of a dressing surface of the dresser based on the cut rate of the polishing pad, the torque or current of the table rotating motor, and the torque or current of the top ring rotating motor.

As the polishing performance of the polishing pad decreases due to wear thereof, characteristic change occurs in the motor current (torque) for rotating the polishing table and the motor current (torque) for rotating the top ring. According to the aforementioned first aspect of the present invention, the condition of the polishing surface of the polishing pad can be diagnosed based not only on the amount of wear of the polishing pad, but also on the motor current for rotating the polishing table and the motor current for rotating the top ring. As a result, the end of the life of the polishing pad can be determined accurately from the diagnosis result.

As the dressing performance of the dresser decreases, characteristic change occurs in the motor current (torque) for rotating the polishing table and the motor current (torque) for rotating the top ring, as with the case where the polishing pad is worn. According to the aforementioned second aspect of the present invention, the condition of the dressing surface of the dresser can be diagnosed based not only on the cut rate of the polishing pad (an amount of the polishing pad removed by the dresser per unit time), but also on the motor current for rotating the polishing table and the motor current for rotating the top ring. As a result, the end of the life of the dresser can be determined accurately from the diagnosis result.

DETAILED DESCRIPTION OF THE PREFERRED EMBODIMENTS

Figure 1:
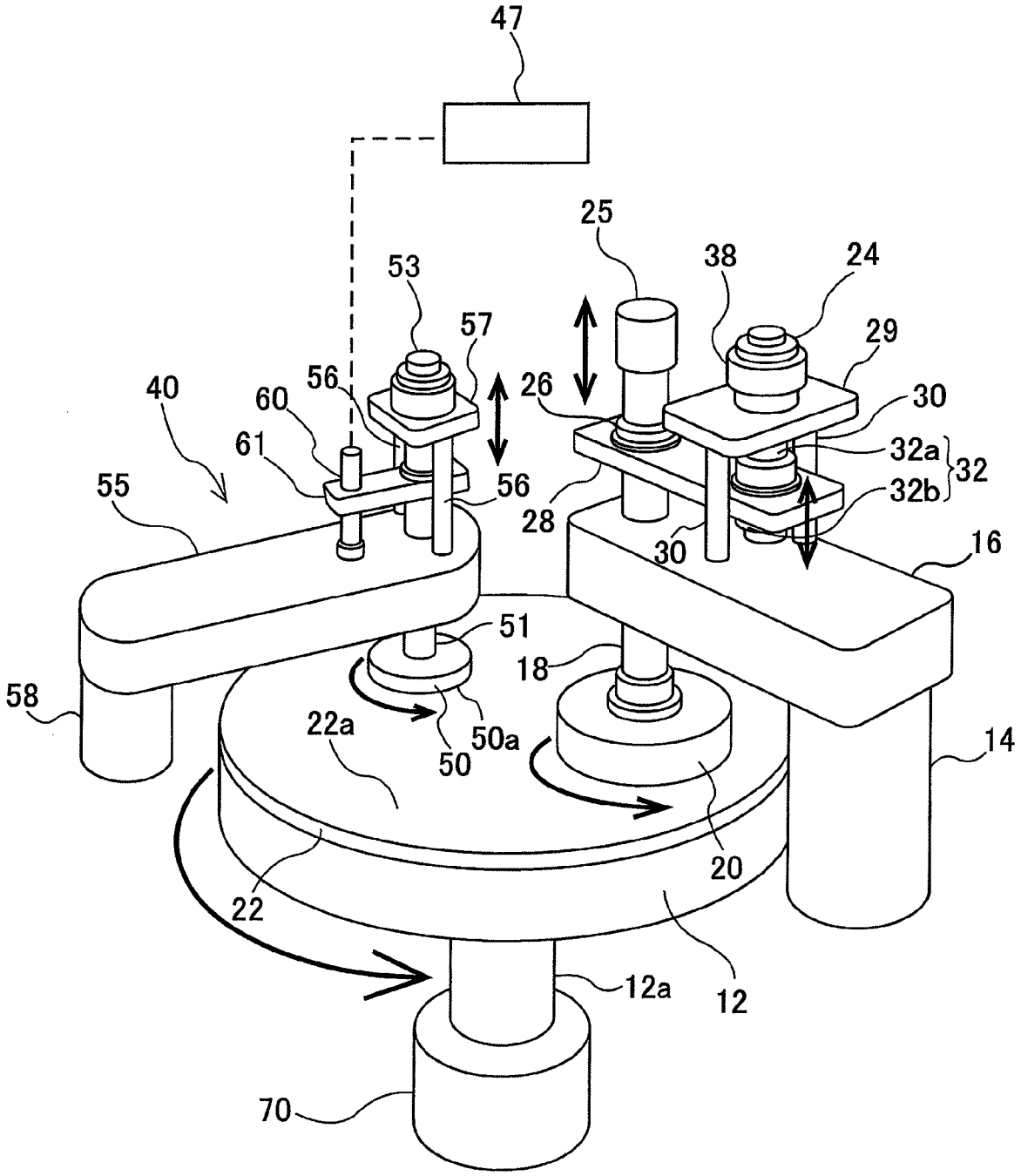
FIG. 1 is a schematic view of a polishing apparatus according to an embodiment of the present invention.

FIG. 1 is a schematic view of a polishing apparatus according to an embodiment of the present invention. As shown in FIG. 1, the polishing apparatus has a polishing table 12, a top ring swing arm 16 coupled to an upper end of a support shaft 14, a top ring shaft 18 supported by a free end of the top ring swing arm 16, a top ring 20 having approximately a disk shape and coupled to a lower end of the top ring shaft 18, and a diagnostic device 47 for processing various kinds of data. Although not shown, the diagnostic device 47 has a storage device for storing the data therein and an arithmetic processor for processing the data. Although not shown in FIG. 1, the top ring shaft 18 is coupled to a top ring rotating motor via a coupling mechanism, such as a timing belt, so that the top ring shaft 18 is rotated by the motor. This rotation of the top ring shaft 18 causes the top ring 20 to rotate about the top ring shaft 18 in a direction indicated by arrow.

The polishing table 12 is coupled to a table rotating motor 70 via a table shaft 12*a*, so that the polishing table 12 is rotated about the table shaft 12*a* by the table rotating motor 70 in a direction indicated by arrow. The table rotating motor 70 is disposed below the polishing table 12. A polishing pad 22 is attached to an upper surface of the polishing table 12. The polishing pad 22 has an upper surface 22*a* that provides a polishing surface for polishing a substrate, such as a semiconductor wafer.

The top ring shaft 18 is moved up and down relative to the top ring swing arm 16 by an elevating mechanism 24. This vertical movement of the top ring shaft 18 causes the top ring 20 to move up and down relative to the top ring swing arm 16. A rotary joint 25 is mounted to an upper end of the top ring shaft 18.

The top ring 20 is capable of holding a substrate (e.g., semiconductor wafer) on a lower surface thereof. The top ring swing arm 16 is configured to pivot with respect to the support shaft 14. The top ring 20 holding the substrate on its lower surface is moved from a substrate receiving position to a position above the polishing table 12 by the pivoting motion of the top ring swing arm 16. Then, the top ring 20 is lowered to press the substrate against the upper surface (polishing surface) 22*a* of the polishing pad 22. During polishing of the substrate, the top ring 20 and the polishing table 12 are rotated, while a polishing liquid is supplied onto the polishing pad 22 from a polishing liquid supply nozzle (not shown) that is located above the polishing table 12. In this manner, the substrate is brought into sliding contact with the polishing surface 22*a* of the polishing pad 22, whereby a surface of the substrate is polished.

The elevating mechanism 24 for vertically moving the top ring shaft 18 and the top ring 20 includes a bridge 28 that rotatably supports the top ring shaft 18 through a bearing 26, a ball screw 32 mounted to the bridge 28, a support base 29 supported by pillars 30, and an AC servomotor 38 provided on the support base 29. The support base 29 that supports the servomotor 38 is coupled to the top ring swing arm 16 via the pillars 30.

The ball screw 32 has a screw shaft 32*a* coupled to the servomotor 38 and a nut 32*b* that engages the screw shaft 32*a*. The top ring shaft 18 is elevated and lowered (i.e., vertically movable) together with the bridge 28. Therefore, when the servomotor 38 operates, the bridge 28 is moved vertically through the ball screw 32, whereby the top ring shaft 18 and the top ring 20 are moved vertically.

The polishing apparatus has a dressing unit 40 for dressing the polishing surface 22*a* of the polishing table 12. This dressing unit 40 includes a dresser 50 that is brought into sliding contact with the polishing surface 22*a*, a dresser shaft 51 coupled to the dresser 50, an air cylinder 53 provided on an upper end of the dresser shaft 51, and a dresser swing arm 55 that rotatably supports the dresser shaft 51. The dresser 50 has a lower surface that provides a dressing surface 50*a*, which is constituted by abrasive grains (e.g., diamond particles). The air cylinder 53 is located on a support base 57 supported by pillars 56, which are secured to the dresser swing arm 55.

The dresser swing arm 55 is driven by a motor (not shown) so as to pivot with respect to a support shaft 58. The dresser shaft 51 is rotated by a motor (not shown). This rotation of the dresser shaft 51 causes the dresser 50 to rotate about the dresser shaft 51 in a direction indicated by arrow. The air cylinder 53 is configured to move the dresser 50 vertically through the dresser shaft 51 and to press the dresser 50 against the polishing surface 22*a* of the polishing pad 22 at a predetermined force.

Dressing of the polishing surface 22*a* of the polishing pad 22 is performed as follows. The dresser 50 is pressed against the polishing surface 22*a* by the air cylinder 53. At the same time, pure water is supplied onto the polishing surface 22*a* from a pure-water supply nozzle (not shown). In this state, the dresser 50 is rotated about the dresser shaft 51 to bring the dressing surface 50*a* into sliding contact with the polishing surface 22*a*. Further, the dresser swing arm 55 pivots with respect to the support shaft 58 to move the dresser 50 in a radial direction of the polishing surface 22*a*. In this manner, the dresser 50 scrapes the polishing pad 22 to thereby dress (regenerate) the polishing surface 22*a*.

In this polishing apparatus, an amount of wear of the polishing pad 22 is measured utilizing a vertical position of the dresser 50. Specifically, the dressing unit 40 has a displacement sensor 60 for measuring a vertical displacement of the dresser 50. This displacement sensor 60 is a pad-height measuring device that measures a height of the polishing pad 22 (i.e., a height of the polishing surface 22*a*). The height of the polishing pad 22 is the height of the upper surface (i.e., the polishing surface 22*a*) of the polishing pad 22, and the displacement sensor 60 measures a change in the height (i.e., a displacement), which is the amount of wear of the polishing pad 22. A reference of the displacement is not in the apparatus. An initially measured height of the polishing surface 22*a* of the polishing pad 22 is used as the reference. That is, the reference is an inherent value in an individual polishing pad and is measured for each individual polishing pad.

A plate 61 is secured to the dresser shaft 51, so that the plate 61 is moved vertically with the vertical movement of the dresser 50. The displacement sensor 60 is secured to the plate 61 and is configured to measure the displacement of the dresser 50 by measuring the displacement of the plate 61. Specifically, the displacement sensor 60 is capable of measuring a relative displacement between a lower end of the displacement sensor 60 and an upper surface of the dresser swing arm 55.

When the air cylinder 53 operates, the dresser 50, the dresser shaft 51, the plate 61, and the displacement sensor 60 are moved together in the vertical direction. In contrast, the dresser swing arm 55 is fixed in its vertical position. The displacement sensor 60 measures the vertical displacement of the dresser 50 with respect to the upper surface of the dresser swing arm 55 to thereby indirectly measure the height of the polishing surface 22*a* of the polishing pad 22. While in this example a contact type displacement sensor is used as the displacement sensor 60, a non-contact type displacement sensor may be used. Specifically, a linear scale, a laser sensor, an ultrasonic sensor, or an eddy current sensor can be used as the displacement sensor 60. Instead of the displacement sensor, a distance sensor for measuring a distance between two points may be used.

The amount of wear of the polishing pad 22 is determined as follows. As an initial step, the air cylinder 53 is operated to bring the dresser 50 into contact with the polishing surface 22*a* of the polishing pad 22 on which initial dressing has already been performed. In this state, the displacement sensor 60 measures an initial position (initial height) of the dresser 50. The measured initial position (initial height) is stored in the diagnostic device 47. After one or more substrates are polished, the dresser 50 is brought into contact with the polishing surface 22*a* again. In this state, the position of the dresser 50 is measured. Since the position of the dresser 50 is displaced downwardly in accordance with the amount of wear of the polishing pad 22, the diagnostic device 47 can determine the amount of wear of the polishing pad 22 by calculating a difference between the initial position and the position of the dresser 50 after polishing.

The dressing unit 40 performs dressing of the polishing pad 22 each time the substrate is polished. Typically, the dressing unit 40 dresses the polishing pad 22 each time one substrate is polished. Dressing is performed before or after substrate polishing, or during substrate polishing. Dressing may be performed before or after substrate polishing, and during substrate polishing. Measured values of the displacement sensor 60 obtained in any of the above dressing processes are used for calculating the amount of wear of the polishing pad 22.

During dressing, the dresser 50 is reciprocated on the polishing pad 22 (i.e., scans the pad) in its radial direction by the pivoting movement of the dresser swing arm 55. The measured values of the height of the polishing pad 22 are transmitted from the displacement sensor 60 to the diagnostic device 47, which calculates an average of the measured values of the height of the polishing pad 22 during dressing. The dresser 50 is reciprocated on the polishing pad 22 (i.e., scans the pad) one or more times in each dressing process.

Figure 2:
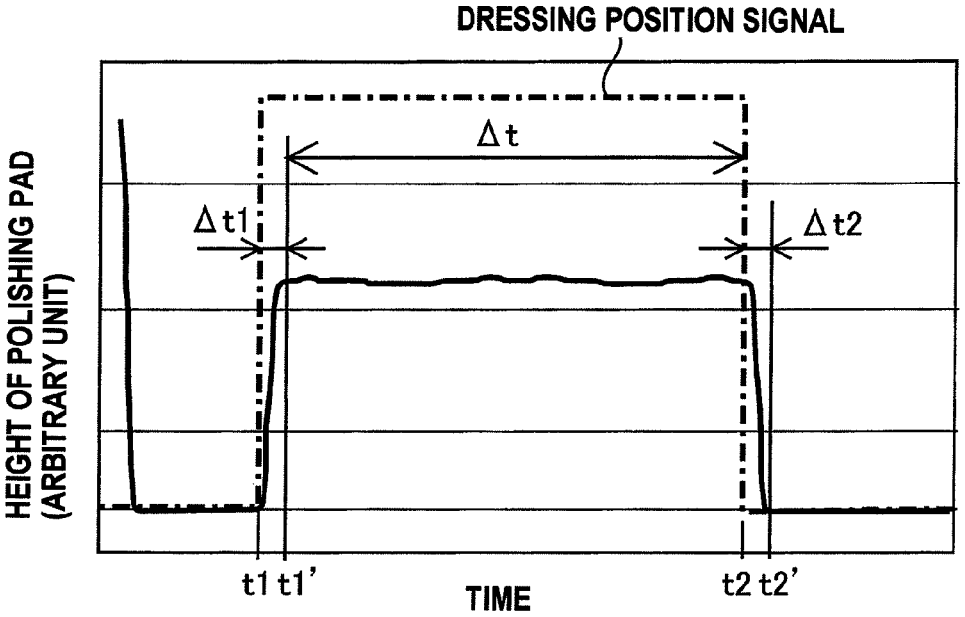
FIG. 2 is a graph showing a height of a polishing pad measured by a displacement sensor.

FIG. 2 is a graph showing the height of the polishing pad 22 measured by the displacement sensor 60. In the graph shown in FIG. 2, a vertical axis represents height of the polishing surface 22*a* of the polishing pad 22, and a horizontal axis represents time. A time t1 indicates a point of time when the dresser 50 starts its downward movement toward the polishing pad 22, and a time t2' indicates a point of time when an upward movement of the dresser 50 from the polishing pad 22 is completed. Therefore, the graph in FIG. 2 shows that dressing of the polishing pad 22 was performed from the time t1 to the time t2'. The displacement sensor 60 measures the height of the polishing pad 22 while the dresser 50 moves on the polishing surface 22*a* by the swinging motion of the dresser swing arm 55 to thereby obtain a plurality of the measured values. The diagnostic device 47 determines the height of the polishing pad 22 based on the measured values obtained.

However, as can be seen from FIG. 2, the measured values obtained at the dressing initial stage in which the dresser 50 starts contacting the polishing pad 22 and at the dressing final stage in which the dresser 50 starts moving away from the polishing pad 22 do not reflect the height of the polishing pad 22 accurately. In view of this, the diagnostic device 47 obtains pad-height measured values that reflect the height of the polishing pad 22 by removing measured values obtained in a predetermined dressing initial period Δt1 and a predetermined dressing final period Δt2 from measured values obtained in a period from when the dresser 50 contacts the polishing pad 22 to when the dresser 50 is separated from the polishing pad 22. Further, the diagnostic device 47 calculates an average of the pad-height measured values obtained. In this manner, the height of the polishing pad 22 is determined using only the measured values obtained during a dressing period Δt that does not include the dressing initial period Δt1 and the dressing final period Δt2.

The dressing initial period Δt1 and the dressing final period Δt2 in the dressing time can be specified as follows. A dashed line shown in FIG. 2 represents a dressing position signal for the dresser 50. This dressing position signal is a signal for determining a dressing position of the dresser 50. The dressing position signal shown in FIG. 2 indicates that the dresser 50 is to dress the polishing pad 22 for a predetermined period from the time t1 to the time t2. Based on this dressing position signal, the dresser 50 performs the vertical movement and the scanning movement. The dressing initial period Δt1 can be determined based on the time t1 of the dressing position signal which indicates a start point of the downward movement of the dresser 50. Specifically, the dressing initial period Δt1 is a predetermined fixed period starting from the time t1 that indicates the dressing start point. In the same manner, the dressing final period Δt2 can be determined based on the time t2 of the dressing position signal which indicates a start point of the upward movement of the dresser 50. Specifically, the dressing final period Δt2 is a predetermined fixed period starting from the time t2 that indicates the dressing end point.

The diagnostic device 47 calculates an average of the plural measured values obtained during one dressing operation, and determines the height of the polishing pad 22 from this average, i.e., the height of the polishing pad 22 is determined to be the average of the measured values. Further, the diagnostic device 47 determines the amount of wear of the polishing pad 22 by calculating the difference between the height of the polishing pad 22 obtained and the initial height of the polishing pad 22 obtained in advance.

Figure 3:
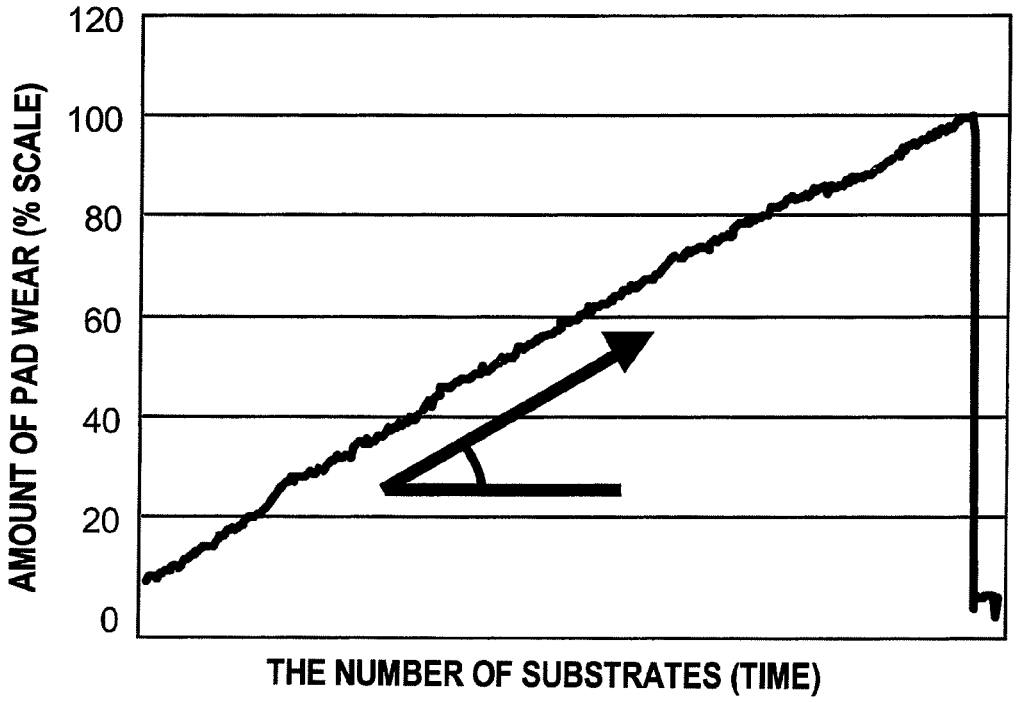
FIG. 3 is a graph showing a relationship between an amount of wear of the polishing pad and the number of substrates polished.

FIG. 3 is a graph showing a relationship between the amount of wear of the polishing pad 22 and the number of substrates polished. In the graph shown in FIG. 3, a vertical axis represents amount of wear of the polishing pad 22 obtained from the measured values of the displacement sensor 60, and a horizontal axis represents the number of substrates polished. The number of substrates on the horizontal axis can also be expressed as time. Therefore, a slope of the graph shown in FIG. 3 indicates the amount of wear of the polishing pad 22 per unit time.

Figure 4:
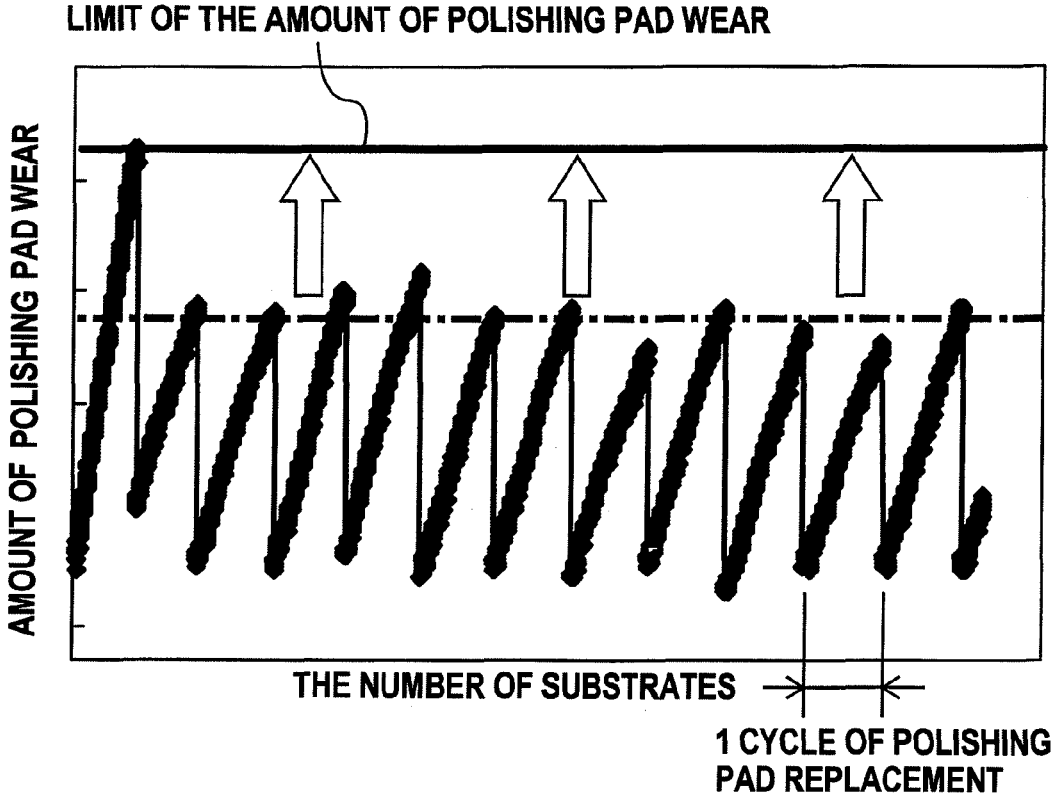
FIG. 4 is a graph showing the amount of wear of the polishing pad and a replacement cycle of the polishing pad.

FIG. 4 is a graph showing the amount of wear of the polishing pad and a replacement cycle of the polishing pad. In the graph shown in FIG. 4, a vertical axis represents amount of wear of the polishing pad 22, and a horizontal axis represents the number of substrates polished. Conventionally, as shown in FIG. 4, the polishing pad 22 was replaced before the amount of wear thereof did not reach its limit. Therefore, if the limit of the amount of pad wear can be grasped accurately, the life of the polishing pad 22 is expected to increase by 10% or more.

In this embodiment, the end of the life of the polishing pad 22 is determined based not only on the amount of wear of the polishing pad 22 measured by the displacement sensor (pad-height sensor) 60, but also on several parameters that change due to the wear of the polishing pad 22. Specifically, motor current (torque) required for rotating the top ring 20 and motor current (torque) required for rotating the polishing table 12 are used as the parameters to be monitored.

Figure 5:
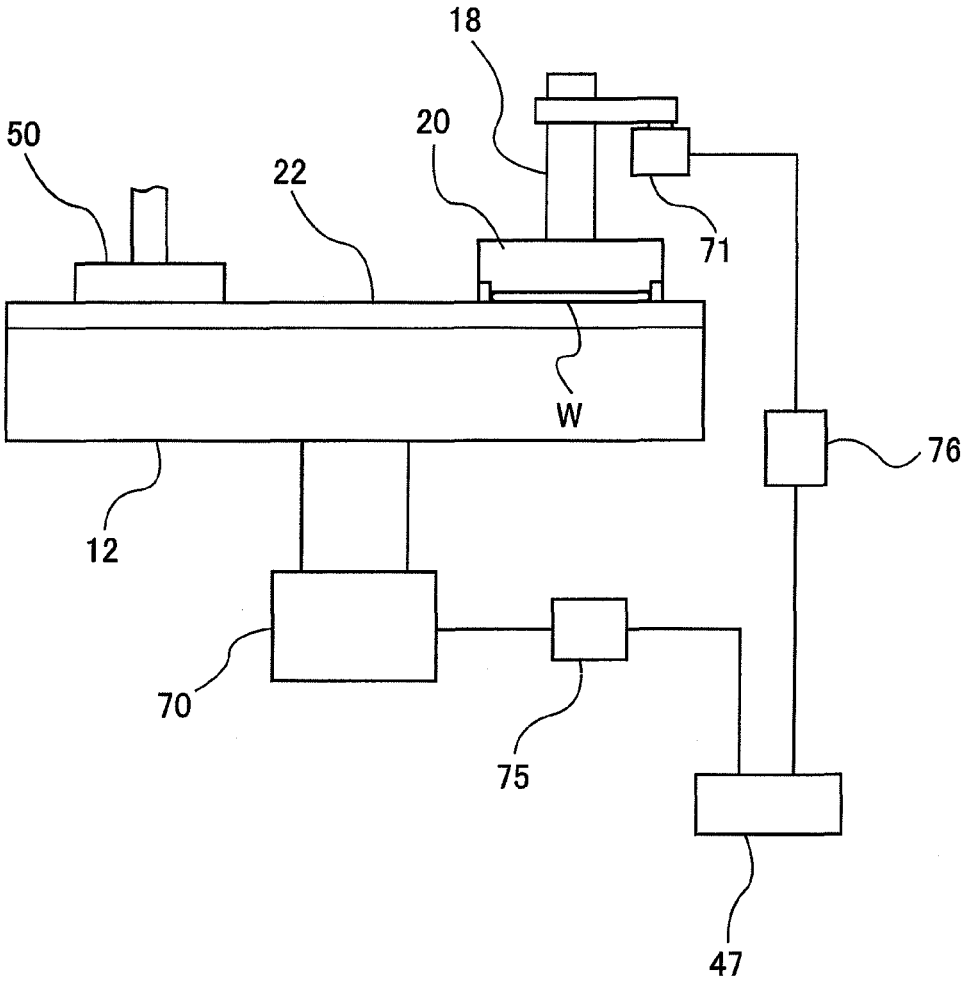
FIG. 5 is a schematic view showing structures of measuring a motor current for rotating a top ring and a motor current for rotating a polishing table.

FIG. 5 is a schematic view showing structures of measuring the motor current for rotating the top ring 20 and the motor current for rotating the polishing table 12. As shown in FIG. 5, the polishing table 12 is rotated by the table rotating motor 70, and the top ring 20 is rotated by the top ring rotating motor 71. A table motor current detector 75 and a top ring motor current detector 76 each for detecting the motor current are coupled to the table rotating motor 70 and the top ring rotating motor 71, respectively. Instead of providing these current detectors 75 and 76, the diagnostic device 47 may monitor currents outputted from motor drivers (not shown) coupled to the motors 70 and 71, respectively.

During polishing of a substrate W, a frictional force is generated between the substrate W and the polishing pad 22, because the surface of the substrate W and the polishing surface 22*a* of the polishing pad 22 are placed in sliding contact with each other. Generally, a polishing rate of the substrate W (which is an amount of film removed from the substrate per unit time, and is also referred to as a removal rate) depends on the frictional force. Specifically, a smaller frictional force between the substrate W and the polishing pad 22 results in a lower polishing rate of the substrate W. This frictional force acts as a resistant torque exerted on the table rotating motor 70 and the top ring rotating motor 71. Therefore, a change in the frictional force between the substrate W and the polishing pad 22 can be detected as torque change in the table rotating motor 70 and the top ring rotating motor 71. Further, the torque change can be detected as change in current of the table rotating motor 70 and the top ring rotating motor 71.

In this embodiment, the currents (i.e., torque currents) of the motors 70 and 71 required for maintaining rotational speeds of the polishing table 12 and the top ring 20 during polishing of the substrate W are detected (or measured) by the table motor current detector 75 and the top ring motor current detector 76. As described previously, the currents (torque currents) of the motors 70 and 71 required for maintaining rotational speeds of the polishing table 12 and the top ring 20 during polishing of the substrate W may be detected from the motor drivers that are coupled to the motors 70 and 71. Moreover, the present invention is not limited to these examples. Any known technique may be used to detect the currents (torque currents) of the motors 70 and 71. Although the following explanations will be described using the motor current, the motor current may be replaced with motor torque. The motor torque can be determined from the motor current or may be determined from a torque value or a current value which is outputted from (and monitored by) the motor driver.

Figure 6A:
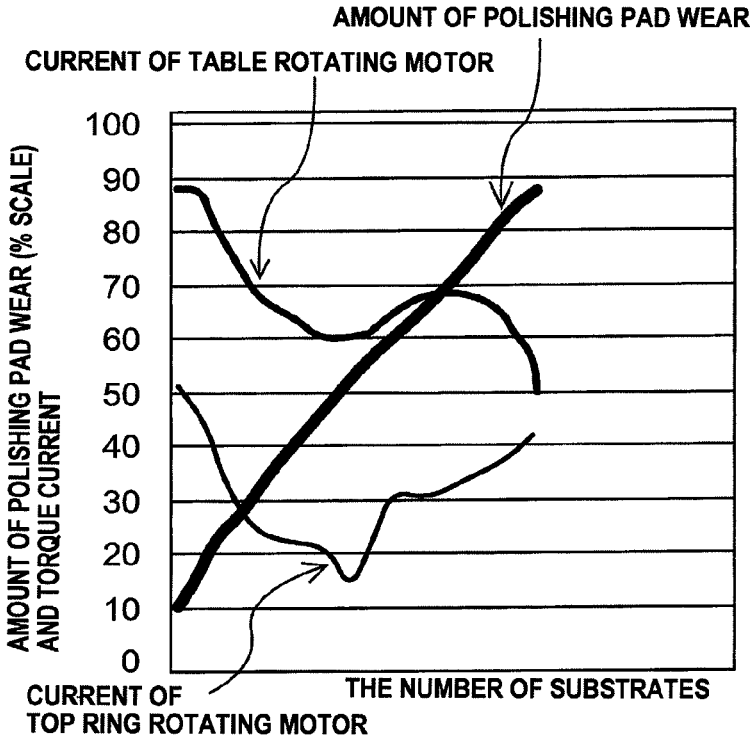
FIG. 6A is a graph showing the currents of the top ring rotating motor and the table rotating motor when the amount of wear of the polishing pad is within an allowable range.
Figure 6B:
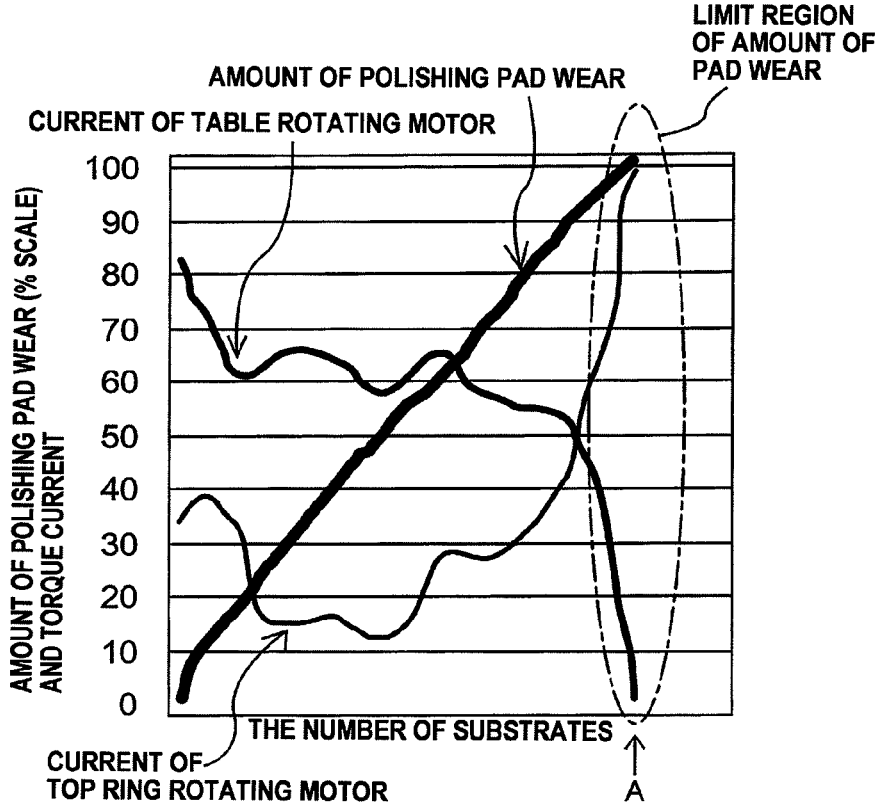
FIG. 6B is a graph showing the currents of the top ring rotating motor and the table rotating motor when the amount of wear of the polishing pad is beyond the allowable range.

FIG. 6A is a graph showing the currents of the top ring rotating motor 71 and the table rotating motor 70 when the amount of wear of the polishing pad 22 is within an allowable range, and FIG. 6B is a graph showing the currents of the top ring rotating motor 71 and the table rotating motor 70 when the amount of wear of the polishing pad 22 is beyond the allowable range. The motor currents shown in FIG. 6A and FIG. 6B are each depicted by plotting an average of measured values of the motor current that are obtained each time one substrate is polished.

In this embodiment, each time one substrate is polished, the diagnostic device 47 calculates the average of the current of the table rotating motor 70 measured during polishing and further calculates the average of the current of the top ring rotating motor 71 measured during polishing. In order to obtain accurate average of the current, it is preferable to calculate the average of the current of the table rotating motor 70 and the average of the current of the top ring rotating motor 71 that are obtained when the polishing table 12 and the top ring 20 are rotated at substantially constant speed. The substantially constant speed means, for example, a speed that falls within a range of 10% above and below a set speed.

As can be seen from comparison between FIG. 6A and FIG. 6B, when the amount of wear of the polishing pad 22 is beyond the allowable range, the current of the table rotating motor 70 decreases greatly, while the current of the top ring rotating motor 71 increases greatly. The possible reasons for this are as follows. Typically, during polishing of the substrate, the polishing table 12 and the top ring 20 are rotated in the same direction as shown in FIG. 1, and rotational speeds thereof are approximately the same. Therefore, a drag torque of the polishing table 12 acts on the top ring 20. As a result, the top ring 20 is rotated by the rotation of the polishing table 12 to some degree. If the wear of the polishing pad 22 progresses until the polishing surface 22*a* cannot polish the substrate, a load on the polishing table 12 decreases and as a result the current of the table rotating motor 70 decreases (i.e., the torque for maintaining the rotational speed of the polishing table 12 decreases). On the other hand, the drag torque of the polishing table 12 does not act on the top ring 20 anymore. As a result, the current of the top ring rotating motor 71 for maintaining the rotational speed of the top ring 20 increases (i.e., the torque for maintaining the rotational speed of the top ring 20 increases).

Figure 7A:
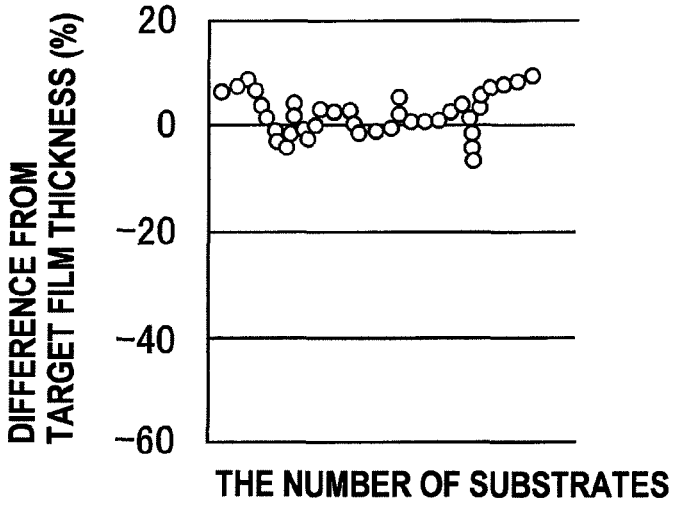
FIG. 7A is a graph showing a difference between actual film thickness of a substrate polished and a preset target film thickness when the amount of wear of the polishing pad is within the allowable range.
Figure 7B:
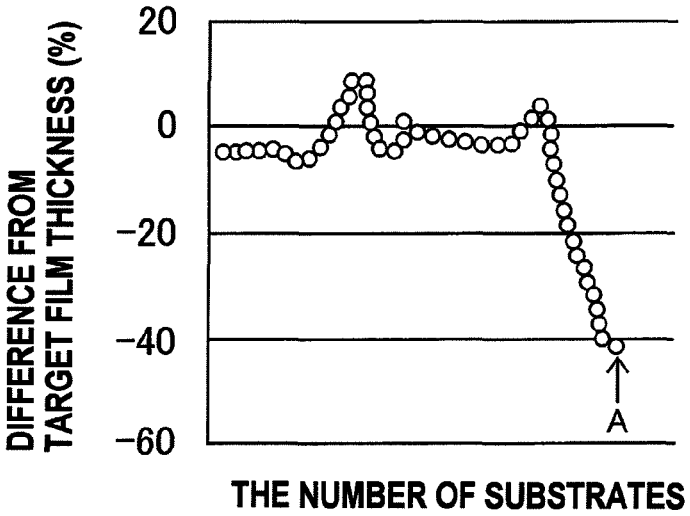
FIG. 7B is a graph showing a difference between actual film thickness of a substrate polished and a preset target film thickness when the amount of wear of the polishing pad is beyond the allowable range.

FIG. 7A is a graph showing a difference between actual film thickness of a substrate polished and a preset target film thickness when the amount of wear of the polishing pad 22 is within the allowable range. FIG. 7B is a graph showing a difference between actual film thickness of a substrate polished and the preset target film thickness when the amount of wear of the polishing pad 22 is beyond the allowable range. The graph shown in FIG. 7A corresponds to the graph shown in FIG. 6A, and the graph shown in FIG. 7B corresponds to the graph shown in FIG. 6B. A point A in FIG. 7B corresponds to a point A in FIG. 6B. As can be seen from FIG. 7A, when the amount of wear of the polishing pad 22 is within the allowable range, the difference between the film thickness of the polished substrate and the target film thickness is small. In contrast, as shown in FIG. 7B, when the amount of wear of the polishing pad 22 goes beyond the allowable range, the difference between the film thickness of the polished substrate and the target film thickness becomes large. Therefore, it is preferable to extend the replacement time, so long as the polishing pad 22 can maintain its polishing performance.

As described above, in this embodiment, the parameters used for determining the end of the life of the polishing pad 22 include, in addition to the amount of wear of the polishing pad 22, the current of the motor 70 for the polishing table 12 and the current of the motor 71 for the top ring 20. When the polishing pad 22 is worn down and as a result the polishing rate decreases greatly, the currents of the motors 70 and 71 show characteristic changes as shown in FIG. 6B. Therefore, it can be said that the currents of the motors 70 and 71 are parameters indicating the decrease in the polishing rate.

The diagnostic device 47 is configured to diagnose a condition of the polishing surface 22*a* of the polishing pad 22 based on the amount of wear of the polishing pad 22 and the change in the polishing rate that is indicated by the currents of the motors 70 and 71 and to determine the end of the life of the polishing pad 22, i.e., the replacement time of the polishing pad 22, from the diagnosis result. Specifically, the diagnostic device 47 monitors the amount of wear of the polishing pad 22 calculated from the measured values of the pad height obtained by the displacement sensor 60, the current of the table rotating motor 70 obtained from the table motor current detector 75 (or the motor driver for the table rotating motor 70), and the current of the top ring rotating motor 71 obtained from the top ring motor current detector 76 (or the motor driver for the top ring rotating motor 71), and determines the end of the lifetime of the polishing pad 22, i.e., a wear limit, based on these parameters.

More specifically, the end of the life of the polishing pad 22 is determined as follows. Each time one substrate is polished, the displacement sensor 60 measures the height of the polishing surface 22*a* of the polishing pad 22, and the diagnostic device 47 calculates the amount of pad wear from the measured value of the height of the polishing pad 22 and the initial height. Further, each time one substrate is polished, the diagnostic device 47 calculates the average of the current of the table rotating motor 70 and the average of the current of the top ring rotating motor 71 that are obtained during polishing of the substrate. The diagnostic device 47 further calculates a moving average of the average of the current of the table rotating motor 70 and a moving average of the average of the current of the top ring rotating motor 71.

The diagnostic device 47 compares the amount of pad wear with a predetermined management value and determines whether or not the amount of pad wear exceeds the predetermined management value. This management value is determined in advance based on characteristics of the polishing pad 22 and/or other factors. When the amount of pad wear exceeds the management value, the diagnostic device 47 determines whether or not the moving average of the average of the current of the top ring rotating motor 71 is more than a first set value and the moving average of the average of the current of the table rotating motor 70 is less than a second set value. If the moving average of the average of the current of the top ring rotating motor 71 is more than the first set value and the moving average of the average of the current of the table rotating motor 70 is less than the second set value, the diagnostic device 47 judges that the polishing pad 22 has reached the end of its life.

Determining of the end of the pad life using the current of the top ring rotating motor 71 and the current of the table rotating motor 70 may be performed as follows. When the amount of pad wear reaches the above-described management value, the diagnostic device 47 determines whether or not a difference between the moving average of the average of the current of the table rotating motor 70 and the moving average of the average of the current of the top ring rotating motor 71 is not more than a predetermined set value. If the above difference is not more than the set value, the diagnostic device 47 judges that the polishing pad 22 has reached the end of its life.

In still another example, when the amount of pad wear reaches the above-described management value, the diagnostic device 47 determines whether or not a difference between a rate of change in the moving average of the average of the current of the top ring rotating motor 71 and a rate of change in the moving average of the average of the current of the table rotating motor 70 is more than a predetermined set value. If the above difference is beyond the set value, the diagnostic device 47 judges that the polishing pad 22 has reached the end of its life.

There may be cases where the average of the current of the table rotating motor 70 and the average of the current of the top ring rotating motor 71 do not fluctuate greatly. Therefore, the calculation of the above-described moving average may be omitted. In this case, the end of the life of the polishing pad 22 can be determined according to the above method using the average of the current of the table rotating motor 70 and the average of the current of the top ring rotating motor 71.

Figure 8:
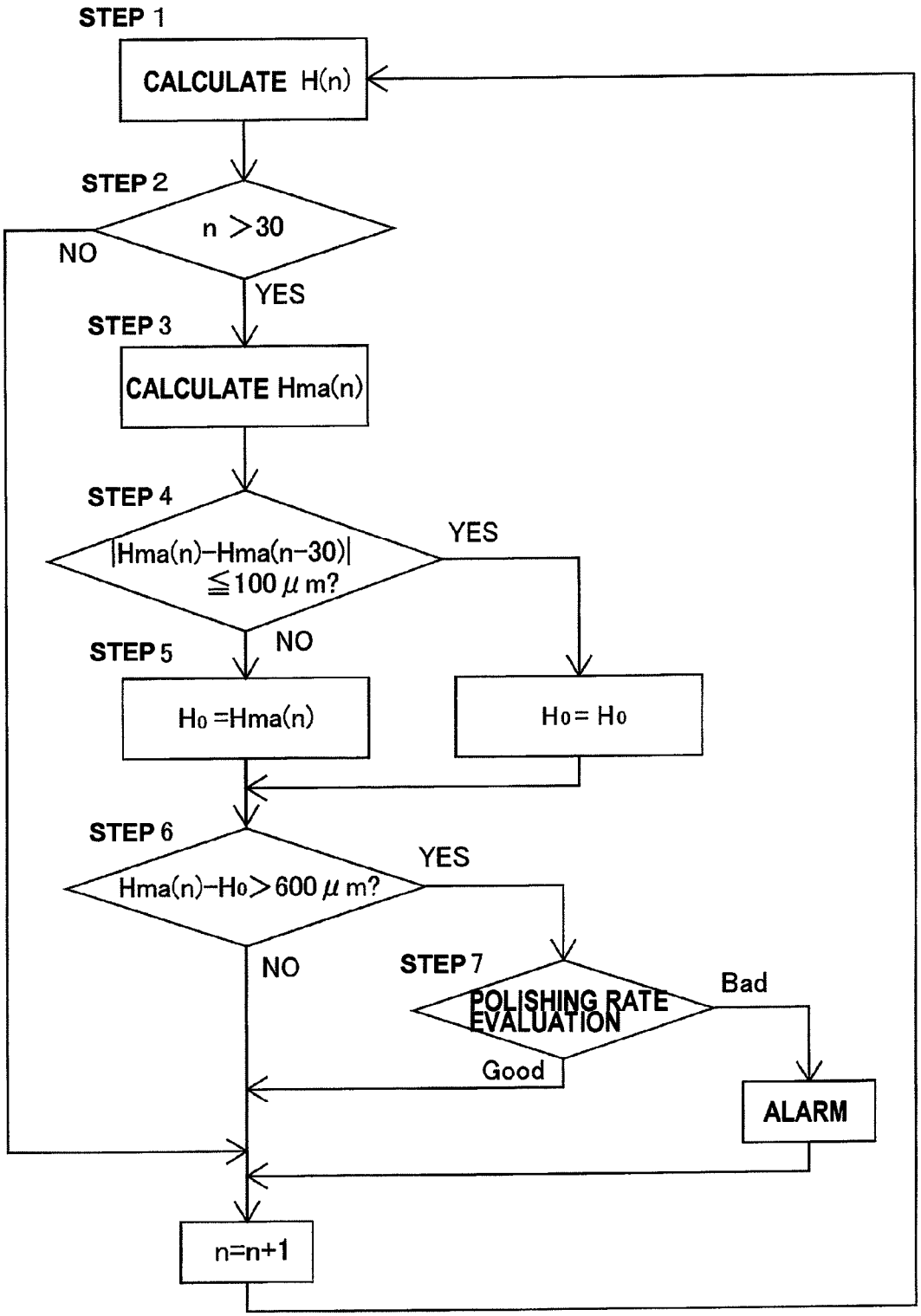
FIG. 8 is a flow chart illustrating a method of determining the end of the life of the polishing pad.

Next, the method of determining the end of the life of the polishing pad 22 will be described in detail with reference to FIG. 8. FIG. 8 is a flow chart illustrating the method of determining the end of the pad life of the polishing pad. In step 1, after a n-th substrate is polished, the displacement sensor 60 measures the height of the polishing pad 22 at plural measurement points while the dresser 50 is reciprocated. The diagnostic device 47 calculates the average of the measured values of the height of the polishing pad 22 to determine a height H(n) of the polishing pad 22 after polishing of the n-th substrate. The height H of the polishing pad 22 is obtained every time the polishing pad 22 is dressed.

In step 2, the diagnostic device 47 determines whether or not the current number n of substrates is larger than a predetermined number. In this embodiment, this predetermined number is set to 30. If the number n of substrates is equal to or smaller than 30, then processing sequence is repeated from the step 1 for the next substrate (i.e., a n+1-th substrate). If the number n of substrates is larger than 30, then the diagnostic device 47 calculates the moving average of the height H(n) of the polishing pad 22 (step 3). Specifically, the moving average is calculated from plural values of the height H of the polishing pad 22 with respect to the predetermined number of substrates. In this embodiment, the heights (H(n), . . . , H(n−30)) of the polishing pad 22 with respect to the latest substrates from the n-th substrate (the current substrate) to a n−30-th substrate (a previously polished substrate) are defined as time-series data. The diagnostic device 47 calculates a moving average Hma(n) which is an average of the time-series data. Specifically, each time the height H(n) of the polishing pad 22 is obtained with respect to the current substrate (n-th substrate), the diagnostic device 47 calculates the moving average Hma(n) of the heights (H(n), . . . , H(n−30)) of the polishing pad 22 with respect to the latest 31 substrates.

Figure 9:
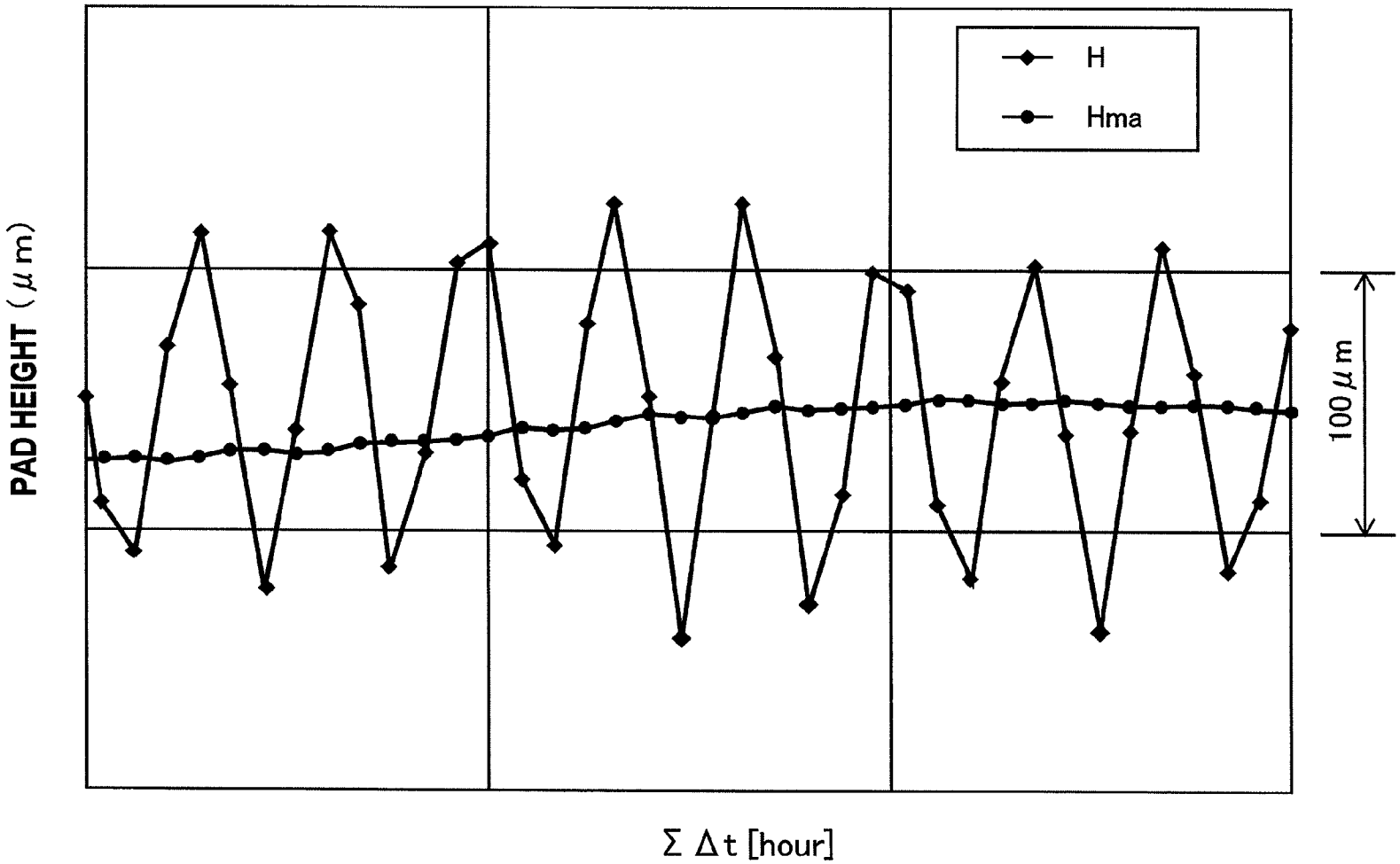
FIG. 9 is a graph showing a change in height of the polishing pad and a change in moving average of the height of the polishing pad.

FIG. 9 is a graph showing a change in the height H of the polishing pad 22 and a change in the moving average Hma of the height of the polishing pad 22. In the graph shown in FIG. 9, a horizontal axis represents dressing cumulative time. As described above, the moving average Hma is the average of the time-series data composed of the pad height values with respect to the last 31 substrates. As can be seen from FIG. 9, the height H of the polishing pad 22 fluctuates greatly and the magnitude of its fluctuation is over 100 μm. In contrast, the moving average Hma of the height of the polishing pad 22 does not fluctuate greatly, and therefore the value of the pad height H is smoothed. The height H and the moving average Hma are obtained every time the polishing pad 22 is dressed. The number of time-series data used in the calculation of one moving average Hma is not limited to 31, and can be selected appropriately. In a case where the fluctuation of the height H of the polishing pad 22 is small, it is not necessary to calculate the moving average Hma. In this case, the amount of wear of the polishing pad 22 is determined from the height H and the initial height of the polishing pad 22.

Referring back to FIG. 8, in step 4, the diagnostic device 47 calculates an absolute value of the difference |Hma(n)−Hma(n−30)| between the moving average Hma(n) with respect to the n-th substrate (the current substrate) and the moving average Hma(n−30) with respect to the n−30-th substrate. Then the diagnostic device 47 determines whether or not the absolute value of the difference obtained is not more than a predetermined threshold value. In this example, the threshold value is set to 100 μm. In step 5, if the difference |Hma(n)−Hma(n−30)| is not more than 100 μm, an initial height H0 of the polishing pad 22 is used as it is for calculating the amount of wear of the polishing pad 22 (i.e., H0=H0). If the difference |Hma(n)−Hma(n−30)| is more than 100 μm, the moving average Hma(n) is used as the initial height H0 of the polishing pad 22 (i.e., H0=Hma(n)). The step 4 and the step 5 are a step of determining whether or not the polishing pad 22 has been replaced. In a case where the replacement time of the polishing pad 22 can be obtained from apparatus information, these steps 4 and 5 may be omitted and the initial height H0 may be renewed.

In step 6, the diagnostic device 47 determines the current amount of wear of the polishing pad 22 by calculating the difference between the moving average Hma(n) and the initial height H0 of the polishing pad 22 and further determines whether or not the amount of wear obtained is larger than the predetermined management value. In this embodiment, the management value is set to 600 μm, which is determined in advance based on the characteristics of the polishing pad 22 and/or other factors.

If the amount of wear of the polishing pad 22 is not larger than the management value, the same processing sequence is repeated from the step 1 with respect to the subsequent substrate (i.e., n+1-th substrate). If the amount of wear of the polishing pad 22 is more than the management value, the diagnostic device 47 evaluates the polishing rate based on the change in the current of the table rotating motor 70 and the change in the current of the top ring rotating motor 71 (step 7). This method of evaluating the polishing rate will be described with reference to FIG. 10. The diagnostic device 47 calculates an average T1(n) of the current of the top ring rotating motor 71 measured during polishing of the n-th substrate and further calculates an average T2(n) of the current of the table rotating motor 70 measured during polishing of the n-th substrate. Scaling of T1(n) and T2(n) may be performed using a representative value of previous data (e.g., a maximum value or a minimum value) or other value. The diagnostic device 47 further calculates a moving average T1ma(n) of the average T1(n) of the current of the top ring rotating motor 71 and a moving average T2ma(n) of the average T2(n) of the current of the table rotating motor 70.

The moving averages T1ma(n) and T2ma(n) are calculated in the same manner as the moving average Hma(n) of the height of the polishing pad 22. Specifically, the moving average T1ma(n) is calculated from averages (T1(n), T1(n−1), . . . , T1(n−N)) of the current of the top ring rotating motor 71 which correspond to the predetermined number of substrates. Similarly, the moving average T2ma(n) is calculated from averages (T2(n), T2(n−1), . . . , T2(n−N)) of the current of the table rotating motor 70 which correspond to the predetermined number of substrates. The number N can be determined appropriately.

Next, the diagnostic device 47 determines whether or not the moving average T1ma(n) of the current of the top ring rotating motor 71 is more than a predetermined first set value P1. If the moving average T1ma(n) is not more than the first set value P1 (i.e., T1ma(n)≤P1), the diagnostic device 47 judges that the polishing rate is good. If the moving average T1ma(n) is more than the first set value P1 (i.e., T1ma(n)>P1), the diagnostic device 47 further determines whether or not the moving average T2ma(n) of the current of the table rotating motor 70 is less than a predetermined second set value P2.

If the moving average T2ma(n) is not less than the second set value P2 (i.e., T2ma(n)≥P2), the diagnostic device 47 judges that the polishing rate is good. If the moving average T2ma(n) is less than the second set value P2 (i.e., T2ma(n)<P2), the diagnostic device 47 judges that the polishing rate is lowered. Referring back to FIG. 8, when the polishing rate is determined to be low, the diagnostic device 47 judges that the polishing pad 22 has reached the end of its life and transmits a notice for the replacement of the polishing pad 22 to an alarm device (not shown), which then raises an alarm.

After transmitting the notice for replacement of the polishing pad 22, the diagnostic device 47 repeats the above-described processing sequence from the step 1 with respect to the next substrate (n+1-th substrate).

Figure 11:
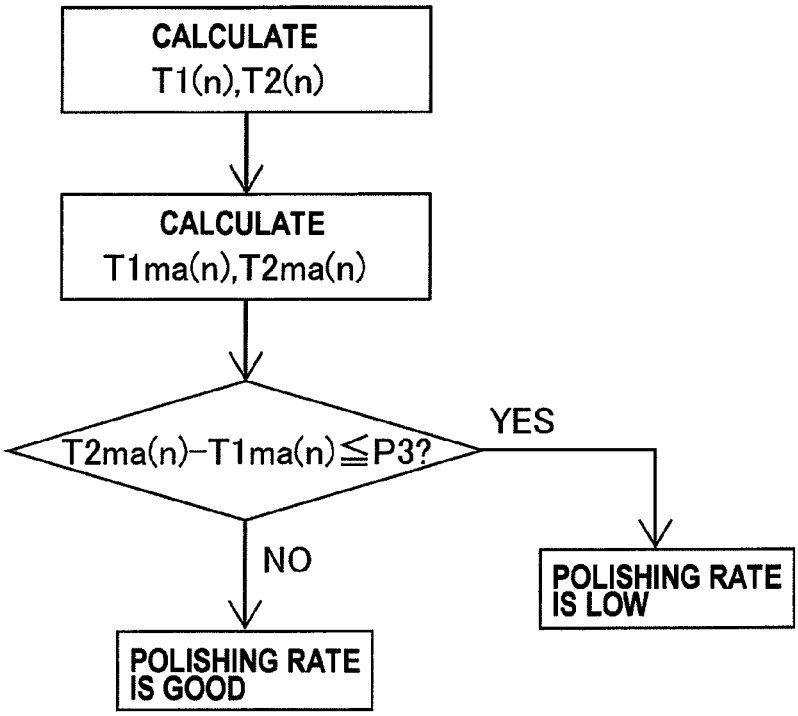
FIG. 11 is a flow chart illustrating another example of the evaluation of the polishing rate.

FIG. 11 is a flow chart illustrating another example of the evaluation of the polishing rate. The diagnostic device 47 calculates the average T1(n) of the current of the top ring rotating motor 71 measured during polishing of the n-th substrate and calculates the average T2(n) of the current of the table rotating motor 70 measured during polishing of the n-th substrate. The diagnostic device 47 further calculates the moving average T1ma(n) of the average T1(n) of the current of the top ring rotating motor 71 and the moving average T2ma(n) of the average T2(n) of the current of the table rotating motor 70.

Next, the diagnostic device 47 determines whether or not a difference between the moving average T2ma(n) and the moving average T1ma(n) is not more than a predetermined set value P3. If the above difference is not more than the set value P3 (i.e., T2ma(n)−T1ma(n)≤P3), the diagnostic value 47 judges that the polishing rate is lowered, i.e., the polishing pad 22 has reached the end of its life, and causes the alarm device (not shown) to raise the alarm. If the above difference is more than the set value P3 (i.e., T2ma(n)−T1ma(n)>P3), the diagnostic device 47 judges that the polishing rate is good, and repeats the above-described processing sequence from the step 1 with respect to the next substrate (i.e., the n+1-th substrate).

Figure 12:
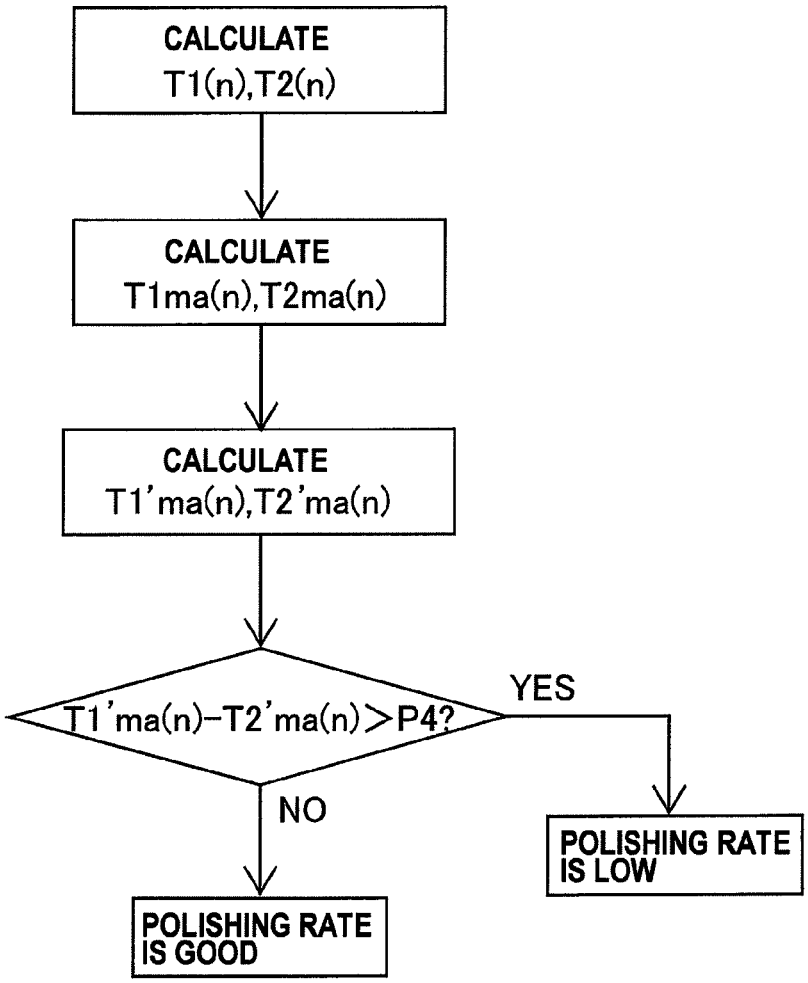
FIG. 12 is a flow chart illustrating still another example of the evaluation of the polishing rate.

FIG. 12 is a flow chart illustrating still another example of the evaluation of the polishing rate. The diagnostic device 47 calculates the average T1(n) of the current of the top ring rotating motor 71 measured during polishing of the n-th substrate (the current substrate) and calculates the average T2(n) of the current of the table rotating motor 70 measured during polishing of the n-th substrate. The diagnostic device 47 further calculates the moving average T1ma(n) of the average T1(n) and the moving average T2ma(n) of the average T2(n).

Next, the diagnostic device 47 calculates a difference (T1ma(n)−T1ma(n−Δn)) between the moving average T1ma(n) of the current of the top ring rotating motor 71 and a moving average T1ma(n−Δn) of the current of the top ring rotating motor 71 which has been calculated after polishing of a n−Δn-th substrate (a previously polished substrate). Further, the diagnostic device 47 divides the above difference (T1ma(n)−T1ma(n−Δn)) by Δn which is a difference in the number of substrates between the n-th substrate and the n−Δn-th substrate to thereby obtain a rate of change T1'ma(n) in the moving average of the current of the top ring rotating motor 71 with respect to the n-th substrate. This rate of change T1'ma(n) is expressed as follows.

$$T1'ma(n)=[T1ma(n)-T1ma(n-\Delta n)]/\Delta n \quad (1)$$

T1'ma(n) may be a derivative of a function y=f(x) at a point n, where y represents T1ma and x represents the number of substrates.

In the same manner, the diagnostic device 47 calculates a difference (T2ma(n)−T2ma(n−Δn)) between the moving average T2ma(n) of the current of the table rotating motor 70 and a moving average T2ma(n−Δn) of the current of the table rotating motor 70 which has been calculated after polishing of the n−Δn-th substrate (previously polished substrate). Further, the diagnostic device 47 divides the above difference (T2ma(n)−T2ma(n−Δn)) by Δn which is the difference in the number of substrates between the n-th substrate and the n−Δn-th substrate to thereby obtain a rate of change in the moving average of the current of the table rotating motor 70 with respect to the n-th substrate. This rate of change in the moving average of the current of the table rotating motor 70 will be referred to as T2'ma(n), which is expressed as follows.

$$T2'ma(n)=[T2ma(n)-T2ma(n-\Delta n)]/\Delta n \quad (2)$$

T2'ma(n) may be a derivative of a function y=f(x) at a point n, where y represents T2ma and x represents the number of substrates.

In this specification, the rate of change in the moving average of the current means an amount of change in the moving average of the current per predetermined number Δn of substrates, where Δn is a natural number which is determined appropriately. This rate of change in the moving average of the current is calculated by the diagnostic device 47 each time one substrate is polished.

Next, the diagnostic device 47 calculates a difference between the rate of change in the moving average T1ma(n) of the current of the top ring rotating motor 71 (i.e., T'1ma(n)) and the rate of change in the moving average T2ma(n) of the current of the table rotating motor 70 (i.e., T2' ma(n)), and determines whether or not this difference (T1' ma(n)−T2' ma(n)) is more than a predetermined set value P4. If the above difference is more than the set value P4 (i.e., T1' ma(n)−T2' ma(n)>P4), the diagnostic value 47 judges that the polishing rate is lowered, i.e., the polishing pad 22 has reached the end of its life, and then causes the alarm device (not shown) to raise an alarm. If the above difference is not more than the set value P4 (i.e., T1' ma(n)−T2' ma(n)≤P4), the diagnostic device 47 judges that the polishing rate is good, and repeats the above-described processing sequence from the step 1 with respect to the next substrate (i.e., the n+1-th substrate).

The polishing rate may be evaluated by still another method including the steps of: measuring the film thickness using a film-thickness measuring device before and after polishing of the substrate; calculating the polishing rate from the measured values of the film thickness and a polishing time; and comparing the polishing rate with a preset value so as to judge whether or not the polishing rate is lowered.

Figure 13:
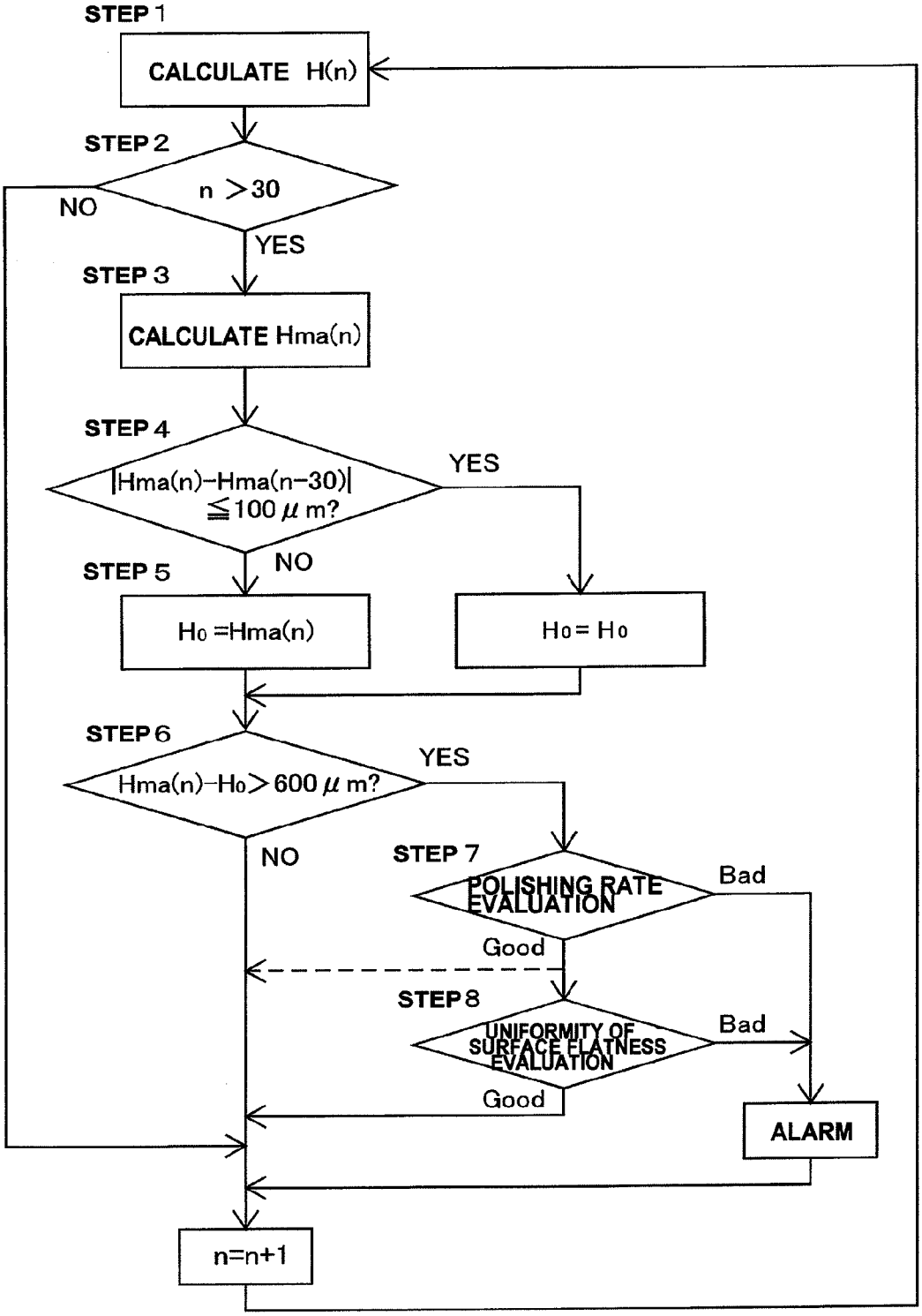
FIG. 13 is a flow chart illustrating a modified example of the method of determining the end of the life of the polishing pad shown in FIG. 8.

In the example shown in FIG. 8, the end of the pad life is determined based on the evaluation of the polishing rate using the motor currents. In addition to the evaluation of the polishing rate, evaluation of a uniformity of surface flatness may be used to determine the end of the life of the polishing pad 22. FIG. 13 is a flow chart illustrating a modified example of the method of determining the end of the life of the polishing pad shown in FIG. 8. In this example, the uniformity of surface flatness is evaluated (in step 8) after the polishing rate is evaluated. If both the evaluation of the polishing rate and the evaluation of the uniformity of surface flatness are good, the diagnostic device 47 repeats the above-described processing sequence from the step 1 with respect to the next substrate (i.e., the n+1-th substrate). If either the evaluation of the polishing rate or the evaluation of the uniformity of surface flatness is bad, the diagnostic value 47 judges that the polishing pad 22 has reached the end of its life and then causes the alarm device (not shown) to raise an alarm. In a case where there is a correlation between the polishing rate and the uniformity of surface flatness, the evaluation of the uniformity of surface flatness in step 8 may be omitted as indicated by dotted arrow shown in FIG. 13.

The uniformity of surface flatness is an index indicating whether or not a film formed on a surface of the substrate is polished uniformly. The uniformity of surface flatness is evaluated by actually measuring the film thickness after polishing of the substrate using a film-thickness measuring device of in-line type or off-line type (not shown).

Figure 10:
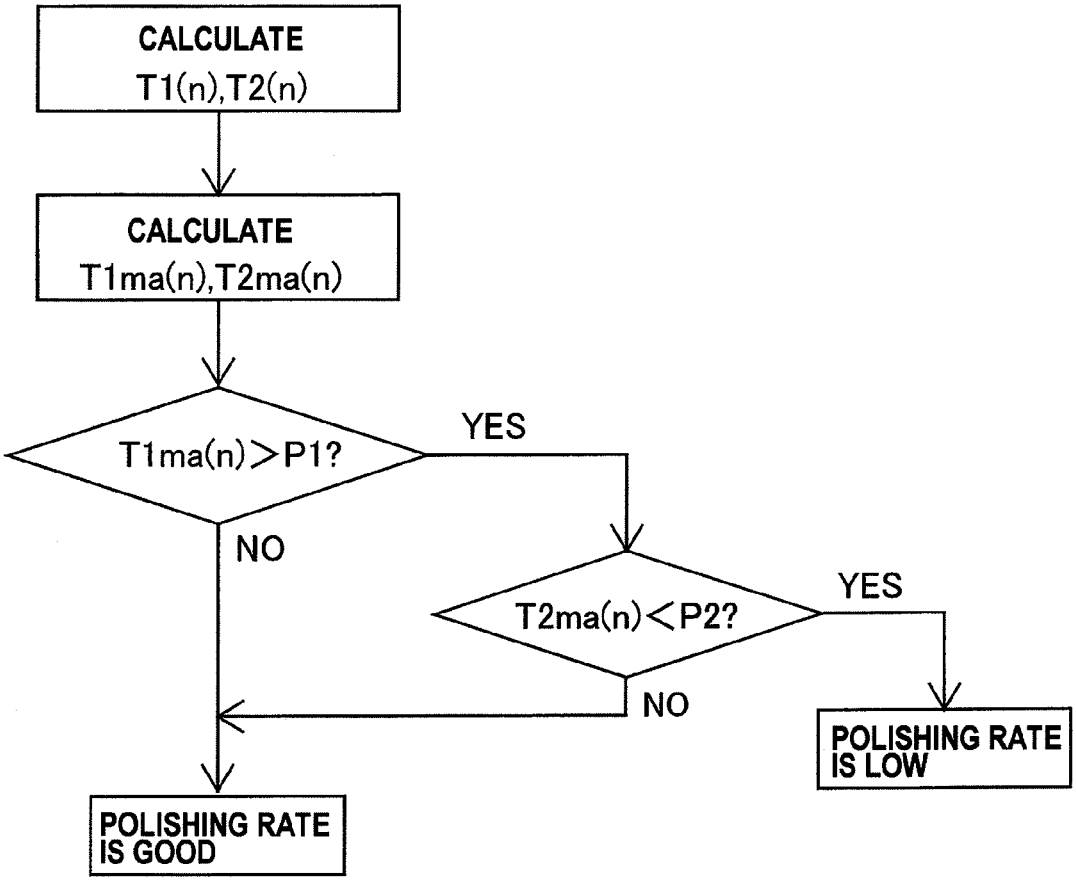
FIG. 10 is a flow chart illustrating evaluation of a polishing rate.
Figure 14:
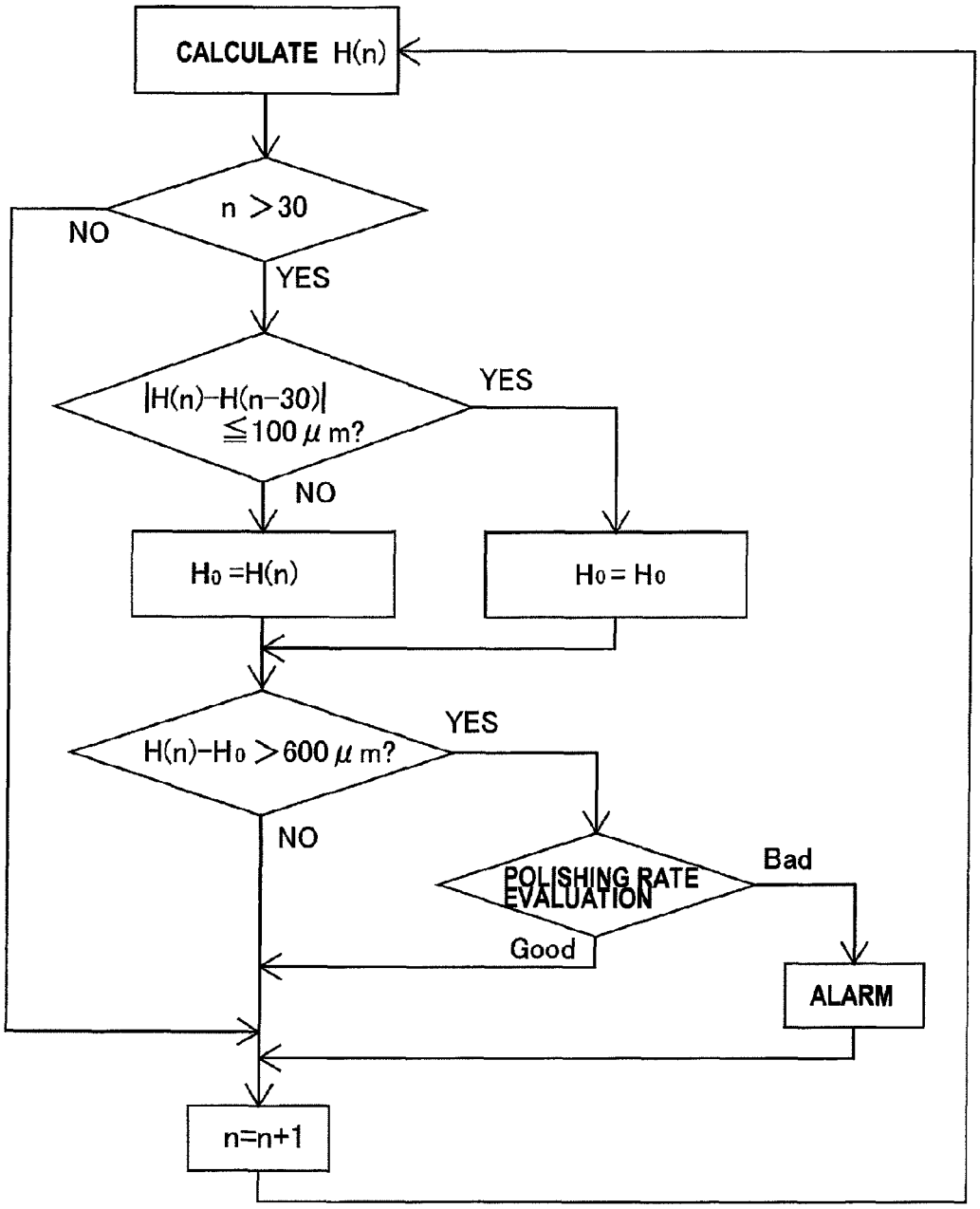
FIG. 14 is a flow chart illustrating another modified example of the method of determining the end of the life of the polishing pad shown in FIG. 8.
Figure 15:
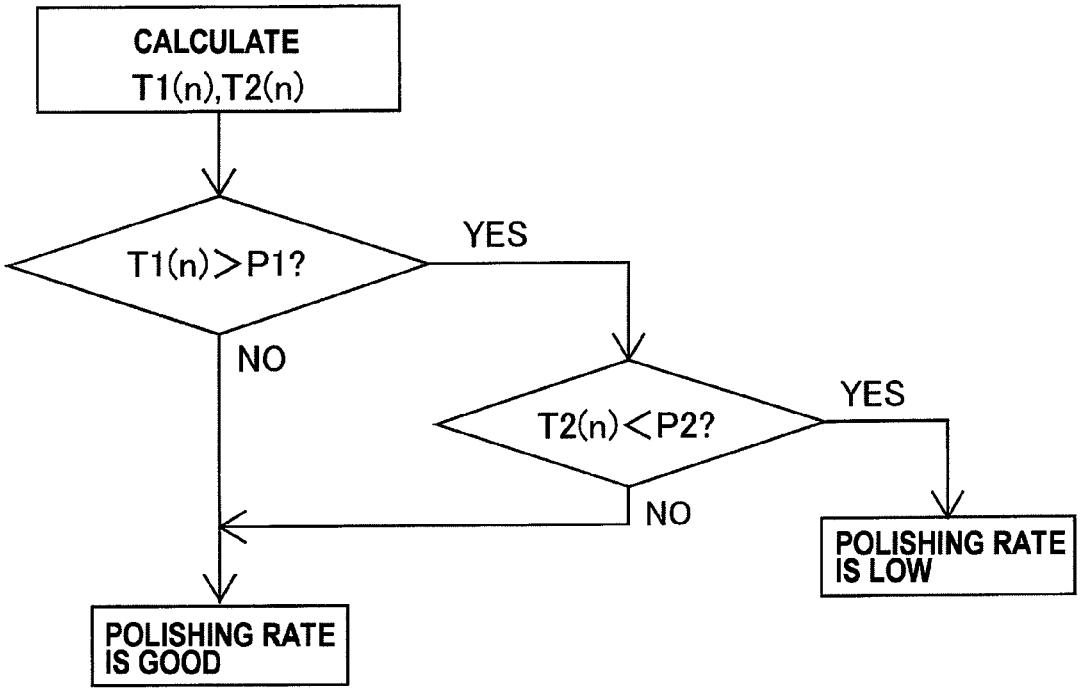
FIG. 15 is a flow chart showing a modified example of the flow chart illustrating the evaluation of the polishing rate shown in FIG. 10.

In the examples shown in FIG. 8 and FIG. 13, the moving average Hma(n) is further calculated from the height H(n) of the polishing pad 22, and the amount of wear of the polishing pad 22 is determined from the moving average Hma(n) and the initial height H0. However, in the case where the height H(n) of the polishing pad 22 does not fluctuate greatly, it is not necessary to calculate the moving average Hma(n). In this case, the flow chart shown in FIG. 8 is modified as shown in FIG. 14. Further, in the examples of FIG. 10 through FIG. 12 also, the polishing rate may be evaluated using the averages T1(n) and T2(n) of the currents, without calculating the moving averages T1ma(n) and T2ma (n) of the currents. For example, the flow chart shown in FIG. 10 is modified as shown in FIG. 15.

The polishing rate can be lowered not only as a result of the wear of the polishing pad 22, but also as a result of deterioration of the dressing performance of the dresser 50. Generally, the dressing performance of the dresser 50 is expressed as a cut rate. This cut rate is an amount of the polishing pad scraped away by the dresser 50 per unit time. If the cut rate is lowered, the polishing surface 22*a* of the polishing pad 22 is not dressed (regenerated) and as a result the polishing rate is lowered. Therefore, the currents of the motors 70 and 71 show characteristic change as shown in FIG. 6B, as with the case where the polishing pad 22 has been worn down. Thus, a condition of the dressing surface 50*a* of the dresser 50 can be diagnosed based on the currents of the motors 70 and 71, and further the end of the life of the dresser 50, i.e., a replacement time of the dresser 50, can be determined from the diagnosis result.

Figure 16:
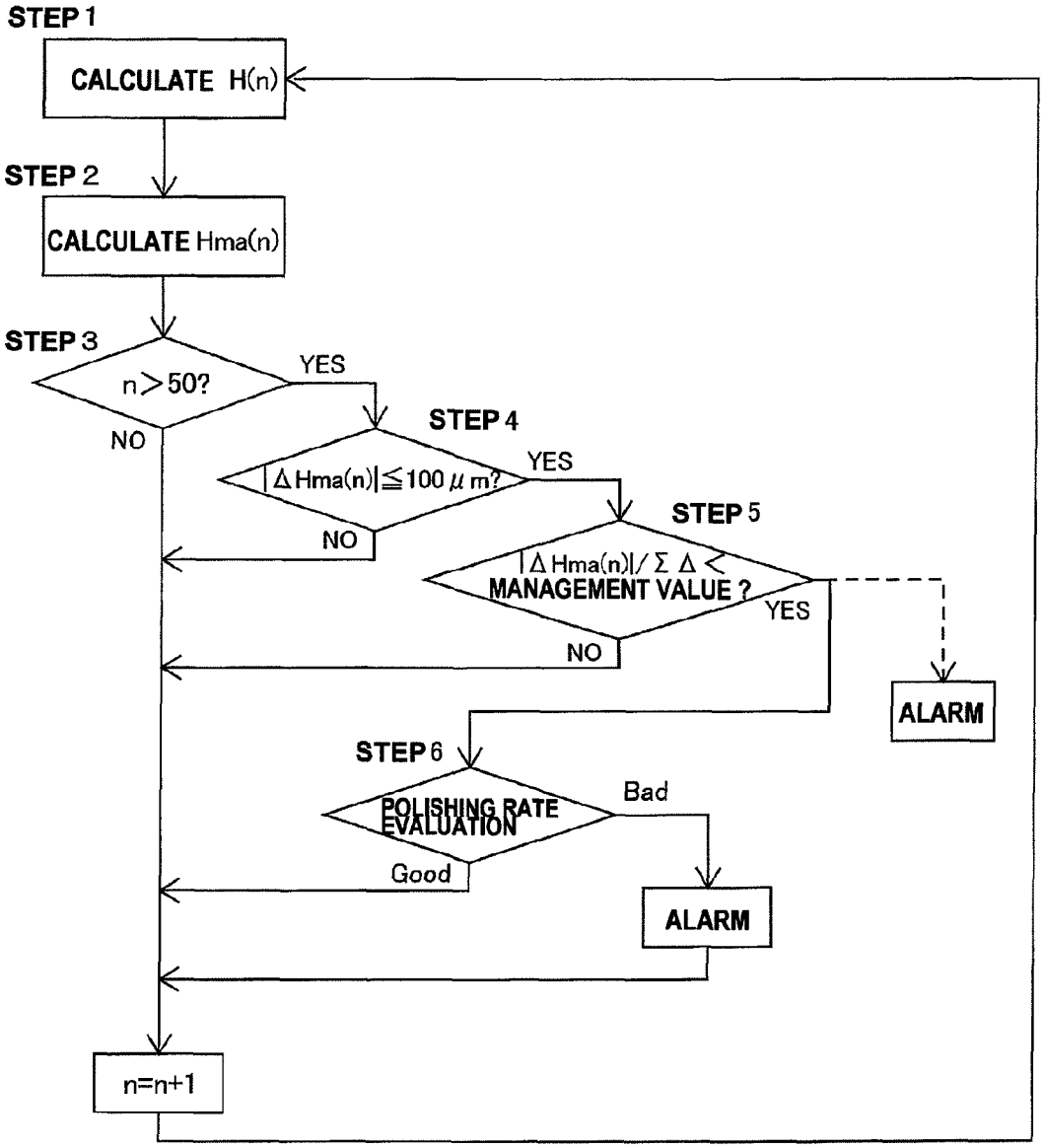
FIG. 16 is a flow chart showing a method of determining the end of a life of a dresser.

An embodiment of determining the end of the life (replacement time) of the dresser 50 will be described below with reference to FIG. 16. FIG. 16 is a flow chart showing a method of determining the end of the life of the dresser 50. In step 1, the diagnostic device 47 determines the height H(n) of the polishing pad 22, and in step 2 the diagnostic device 47 calculates the moving average Hma(n) of the height H(n) of the polishing pad 22. The height H of the polishing pad 22 and its moving average Hma are obtained each time the substrate is polished.

In step 3, the diagnostic device 47 determines whether or not the current number n of substrates is more than a predetermined number. In this embodiment, this predetermined number is set to 50. If the number n of substrates is not more than 50, processing sequence is repeated from the step 1 with respect to the next substrate (n+1-th substrate). If the number n of substrates is more than 50, the diagnostic device 47 calculates an absolute value of a difference |ΔHma(n)| between the moving average Hma(n) with respect to the n-th substrate (the current substrate) and a moving average Hma(n−50) with respect to a n−50-th substrate. In step 4, the diagnostic device 47 determines whether or not the absolute value of the difference |ΔHma (n)|=|Hma(n)−Hma(n−50)| is not more than a predetermined threshold value. In this example, the predetermined threshold value is set to 100 μm.

If the absolute value of the difference |ΔHma(n)| is more than 100 μm, the processing sequence is repeated from the step 1 with respect to the next substrate (n+1-th substrate). If the absolute value of the difference |ΔHma(n)| is not more than 100 μm, the diagnostic value 47 determines whether or not the cut rate of the polishing pad 22 is less than a predetermined management value (step 5). The cut rate of the polishing pad 22 is obtained by dividing the above-described absolute value of the difference |ΔHma(n)| by a total dressing time ΣΔt (i.e., a cumulative dressing time) per 50 substrates polished. Specifically, the cut rate is given by $$|Hma(n)-Hma(n-50)|/\Sigma\Delta t \tag{3}$$

Figure 17:
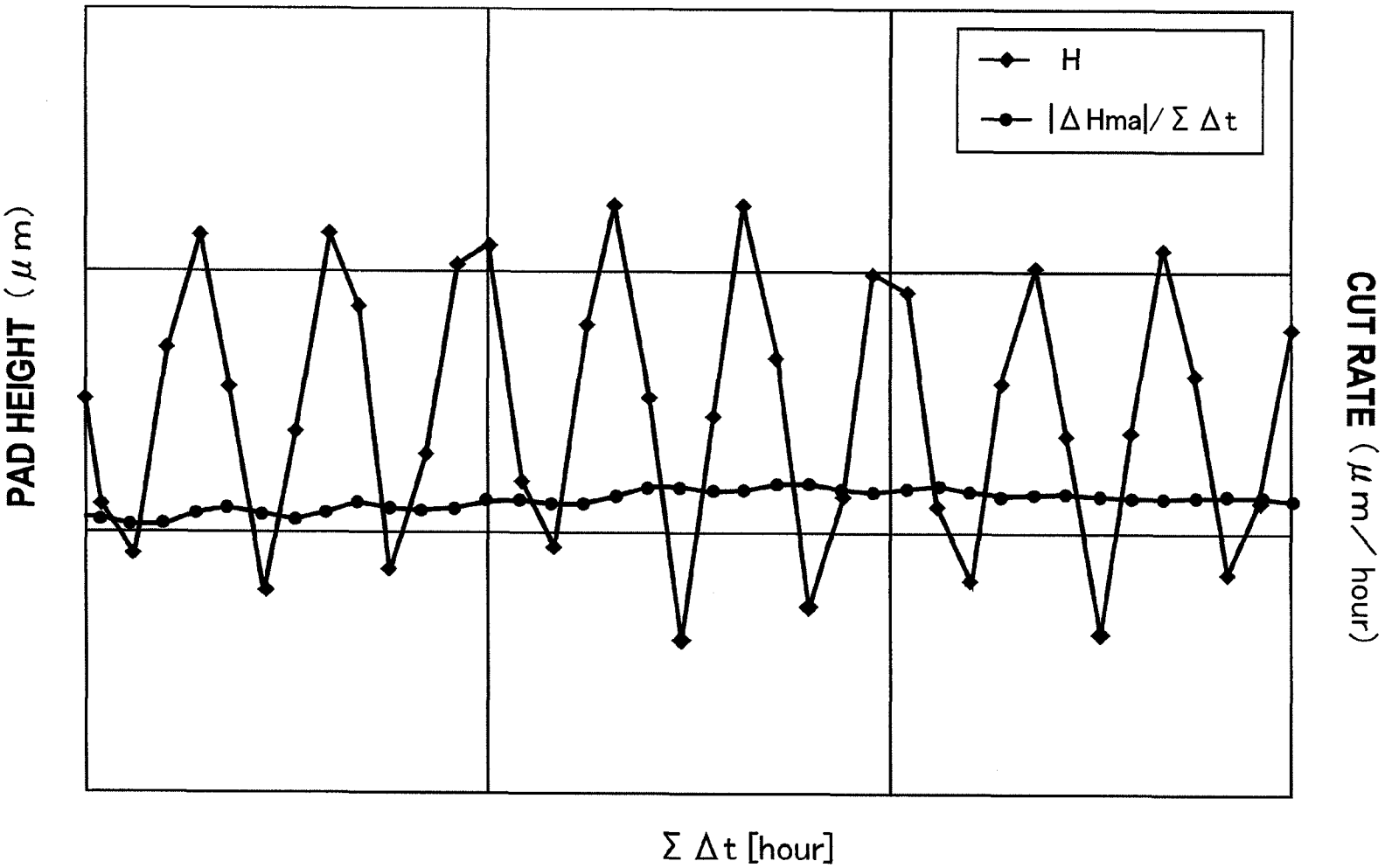
FIG. 17 is a graph showing a change in height of the polishing pad and a change in cut rate of the polishing pad.

FIG. 17 is a graph showing a change in the height H and a change in the cut rate |ΔHma|/ΣΔt of the polishing pad 22. If the cut rate obtained is not less than the aforementioned management value, the processing sequence is repeated from the step 1 with respect to the next substrate (n+1-th substrate). If the cut rate obtained is less than the aforementioned management value, the diagnostic device 47 evaluates the polishing rate based on the change in the current of the table rotating motor 70 and the change in the current of the top ring rotating motor 71 (step 6). This polishing rate evaluation is performed in the same manner as the polishing rate evaluation illustrated in the flow chart in FIG. 8, and therefore the detailed explanations thereof are omitted.

If the polishing rate is determined to be good, the processing sequence is repeated from the step 1 with respect to the next substrate (n+1-th substrate). If the polishing rate is determined to be low, the diagnostic value 47 judges that the dresser 50 has reached the end of its life and transmits a notice for replacement of the dresser 50 to the alarm device (not shown), which then raises an alarm. After transmitting the notice for replacement of the dresser 50, the diagnostic device 47 repeats the above-described processing sequence from the step 1 with respect to the next substrate (n+1-th substrate). After transmitting the notice for replacement of the dresser 50, the diagnostic device 47 repeats the above-described processing sequence from the step 1 with respect to the next substrate (n+1-th substrate). In this manner, the replacement time of the dresser 50 can be determined based on the cut rate of the polishing pad 22, the current of the table rotating motor 70, and the current of the top ring rotating motor 71.

In this embodiment also, the cut rate may be determined from the height H(n) of the polishing pad 22, without calculating the moving average Hma(n) of the height of the polishing pad 22. Similarly, the polishing rate may be evaluated using the averages T1(n) and T2(n) of the current, without calculating the moving averages T1ma(n) and T2ma (n) of the current. Further, as indicated by dotted arrow shown in FIG. 16, if the cut rate is less than the aforementioned management value, the diagnostic device 47 may cause the alarm device (not shown) to raise an alarm.

Figure 18:
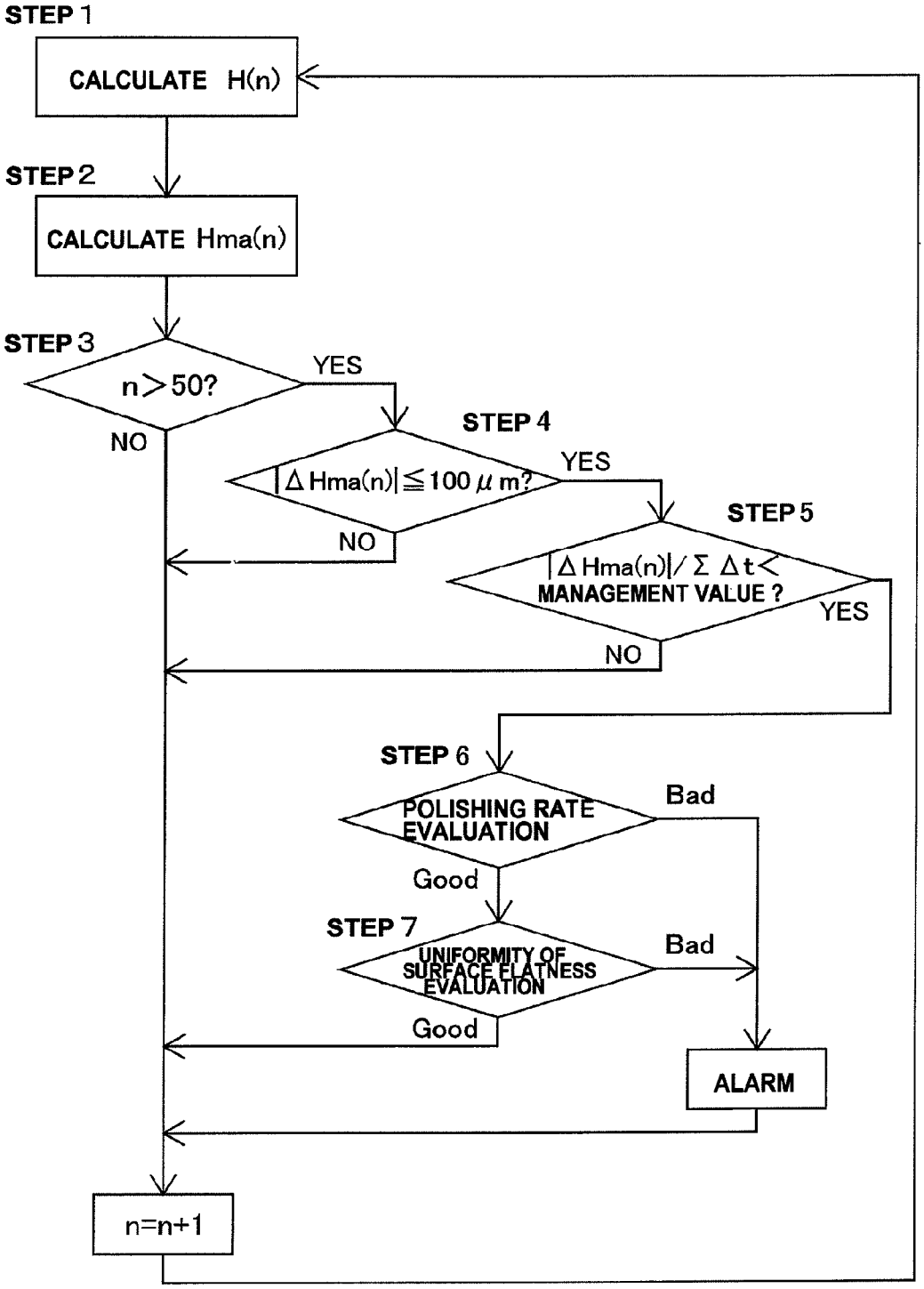
FIG. 18 is a flow chart showing a modified example of the method of determining the end of the life of the dresser shown in FIG. 16.

As with the example shown in FIG. 13, the end of the dresser life may be determined based on the evaluation of the uniformity of the surface flatness, in addition to the evaluation of the polishing rate. FIG. 18 is a flow chart showing a modified example of the method of determining the end of the life of the dresser shown in FIG. 16. In this example, if both of the evaluation of the polishing rate and the evaluation of the uniformity of the surface flatness are good, the processing sequence is repeated from the step 1 for the next substrate (i.e., n+1-th substrate). If either the evaluation of the polishing rate or the evaluation of the uniformity of the surface flatness is bad, the diagnostic device 47 judges that the polishing rate is lowered, i.e., the dresser 50 has reached the end of its life, and causes the alarm device (not shown) to raise an alarm.

As described above, according to the present invention, the replacement times of the polishing pad and the dresser can be determined accurately based on the change in the current of the top ring rotating motor and the change in the current of the table rotating motor both of which indicate the reduction of the polishing rate. Therefore, the replacement frequencies of the polishing pad and the dresser, which are consumables, can be reduced, and the running costs of the polishing apparatus can thus be reduced. Further, as a result of less frequencies of the replacement of the polishing pad and the dresser, the operating rate of the polishing apparatus can be improved. The states in which the polishing pad and the dresser have reached the end of their lives include a reduction of the polishing rate, a deterioration of the uniformity of the surface flatness, and an increase in defects, all of which lead to a lowered yield.

A top ring having air bag is one example of the top ring 20. This type of top ring has one or plural air bags that provides the lower surface of the top ring (i.e., the substrate-holding surface). The air bag is supplied with a gas (e.g., a pressurized air) to thereby press the substrate against the polishing pad 22 via pressure of the gas. When using such top ring, it is possible to monitor the condition of the polishing pad based on measured values of a flow rate of the gas supplied to the air bag, instead of the current or torque of the motors. Specifically, the diagnostic device 47 measures a maximum range of the flow rate obtained during polishing of each substrate and compares an average (or a moving average) of maximum ranges of the flow rate with respect to a predetermined number N of substrates with a predetermined management value so as to diagnose the condition of the polishing pad. The aforementioned maximum range is a magnitude between peak and peak of a wave depicted by the flow rate that fluctuates due to vibration and the like. For example, if the average (or moving average) of the flow rate ranges has reached the management value, the diagnostic device 47 judges that the polishing pad has reached the end of its life.

In another example, instead of monitoring the average of the flow rate, the diagnostic device 47 may perform a frequency analysis (FFT) of the flow rate of the gas supplied to the air bag so as to judge the condition of the polishing pad from the result of FFT. Typically, the flow rate of the gas fluctuates according to a rotation period of the polishing table 12. Therefore, by performing the frequency analysis (FFT) of the flow rate of the gas supplied to the air bag, the diagnostic device 47 can selectively monitor a power spectrum (fluctuation of the flow rate) at the same frequency as that of the rotation period of the polishing table 12 and to compare the power spectrum with a predetermined management value so as to diagnose the condition of the polishing pad. In addition, if the power spectrum shows a large value at a certain frequency other than the selected frequency, the diagnostic device 47 can judges that some problem, other than the life of the polishing pad, has occurred. That is, the diagnostic device 47 can classify abnormalities.

Figure 19:
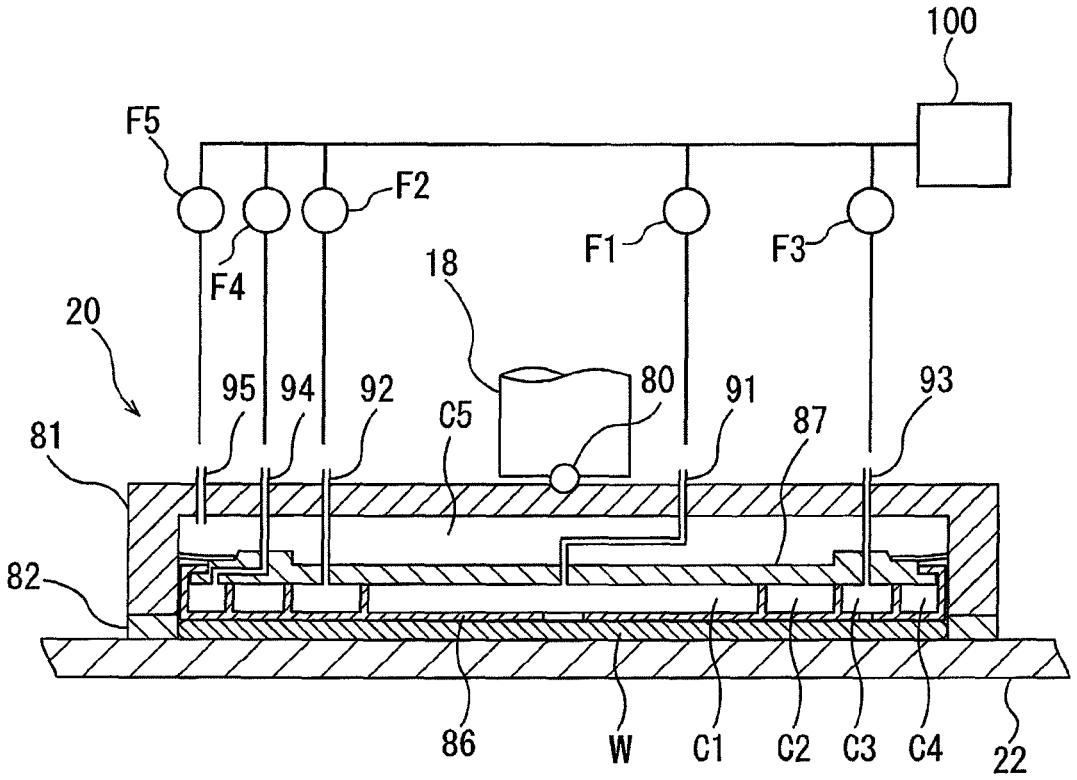
FIG. 19 is a cross-sectional view showing an example of the top ring having multiple air bags for pressing plural zones of the substrate independently.

FIG. 19 is a cross-sectional view showing an example of the top ring having multiple air bags for pressing plural zones of the substrate independently. The top ring 20 has a top ring body 81 coupled to the top ring shaft 18 via a universal joint 80, and a retainer ring 82 provided on a lower portion of the top ring body 81. The top ring 20 further has a circular membrane 86 to be brought into contact with the substrate W, and a chucking plate 87 that holds the membrane 86. The membrane 86 and the chucking plate 87 are disposed beneath the top ring body 81. Four air bags (pressure chambers) C1, C2, C3, and C4 are provided between the membrane 86 and the chucking plate 87. The air bags C1, C2, C3, and C4 are formed by the membrane 86 and the chucking plate 87. The central air bag C1 has a circular shape, and the other air bags C2, C3, and C4 have an annular shape. These air bags C1, C2, C3, and C4 are in a concentric arrangement.

Pressurized fluid (e.g., pressurized air) is supplied into the air bags C1, C2, C3, and C4 or vacuum is developed in the air bags C1, C2, C3, and C4 by a pressure-adjusting device 100 through fluid passages 91, 92, 93, and 94, respectively. The internal pressures of the air bags C1, C2, C3, and C4 can be changed independently to thereby independently adjust pressing forces applied to four zones of the substrate W: a central zone, an inner middle zone, an outer middle zone, and a peripheral zone. Further, by elevating or lowering the top ring 20 in its entirety, the retainer ring 82 can press the polishing pad 22 at a predetermined pressing force.

An air bag C5 is formed between the chucking plate 87 and the top ring body 81. Pressurized fluid is supplied into the air bag C5 or vacuum is developed in the air bag C5 by the pressure-adjusting device 100 through a fluid passage 95. With this operation, the chucking plate 87 and the membrane 86 in their entirety can move up and down. Flow rate measuring devices F1, F2, F3, F4, and F5 each for measuring the flow rate of the pressurized fluid are provided on the fluid passages 91, 92, 93, 94, and 95, respectively. Output signals (i.e., measured values of the flow rate) of these flow rate measuring devices F1, F2, F3, F4, and F5 are sent to the diagnostic device 47 (see FIG. 1).

The retainer ring 82 is arranged around the substrate W so as to prevent the substrate W from coming off the top ring 20 during polishing. The membrane 86 has an opening in a portion that forms the air bag C3, so that the substrate W can be held by the top ring 20 via the vacuum suction by producing vacuum in the air bag C3. Further, the substrate W can be released from the top ring 20 by supplying nitrogen gas or clean air into the air bag C3.

The polishing apparatus has a controller (not shown) configured to determine target values of internal pressures of the air bags C1, C2, C3, and C4 based on the progress of polishing at measurement points lying at corresponding positions of the air bags C1, C2, C3, and C4. The controller sends command signal to the pressure-adjusting device 100 and controls the pressure-adjusting device 100 such that the pressures in the air bags C1, C2, C3, and C4 are maintained at the above target values, respectively. The top ring 24 having the multiple air bags can polish the film uniformly because the air bags can independently press the respective zones on the surface of the substrate against the polishing pad 22 according to the progress of polishing.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing apparatus comprising:

a polishing table for supporting a polishing pad;

a top ring configured to press a substrate against a polishing surface of the polishing pad;

a table rotating motor configured to rotate said polishing table about its own axis;

a top ring rotating motor configured to rotate said top ring about its own axis;

a pad-height measuring device configured to measure a height of the polishing pad; and a diagnostic device configured to monitor the height of the polishing pad, a torque or current of said table rotating motor, and a torque or current of said top ring rotating motor, wherein said diagnostic device is configured to (i) calculate an amount of wear of the polishing pad from the height of the polishing pad, (ii) diagnose a life of the polishing pad based on all of three factors, which are (1) the amount of the wear of the polishing pad, (2) a change in the torque or current of said table rotating motor during a period in which a plurality of substrates have been polished, and (3) a change in the torque or current of said top ring rotating motor during the period in which the plurality of substrates have been polished, and (iii) provide notification that the polishing pad should be replaced when the diagnosed life of the polishing pad has reached an end, wherein said diagnostic device is configured to calculate an average of the torque or current of said table rotating motor obtained each time one substrate is polished and an average of the torque or current of said top ring rotating motor obtained each time one substrate is polished and to diagnose the life of the polishing pad based on the amount of the wear of the polishing pad, the average of the torque or current of said table rotating motor, and the average of the torque or current of said top ring rotating motor, and wherein said diagnostic device is configured to judge the life of the polishing pad based on a combination of the amount of wear of the polishing pad, and a point of time when the average of the current of said table rotating motor becomes more than the average of the current of said top ring rotating motor.

2. The polishing apparatus according to claim 1, wherein said diagnostic device is configured to judge that the polishing pad has reached the end of its life if the amount of the wear of the polishing pad is more than a predetermined management value, the average of the torque or current of said top ring rotating motor is more than a first set value, and the average of the torque or current of said table rotating motor is less than a second set value.

3. The polishing apparatus according to claim 1, wherein said diagnostic device is configured to judge that the polishing pad has reached the end of its life if the amount of the wear of the polishing pad is more than a predetermined management value and a difference between the average of the torque or current of said table rotating motor and the average of the torque or current of said top ring rotating motor is not more than a preset value.

4. The polishing apparatus according to claim 1, wherein said diagnostic device is configured to judge that the polishing pad has reached the end of its life if the amount of the wear of the polishing pad is more than a predetermined management value and a difference between a rate of change in the average of the torque or current of said top ring rotating motor and a rate of change in the average of the torque or current of said table rotating motor is more than a preset value.

5. The polishing apparatus according to claim 1, wherein said diagnostic device is configured to calculate the average of the torque or current of said table rotating motor when said polishing table is rotated at substantially a constant speed during polishing of the substrate and to calculate the average of the torque or current of said top ring rotating motor when said top ring is rotated at substantially a constant speed during polishing of the substrate.

6. The polishing apparatus according to claim 1, wherein said diagnostic device is configured to calculate a moving average of the average of the torque or current of said table rotating motor and a moving average of the average of the torque or current of said top ring rotating motor, and to diagnose the life of the polishing pad based on the amount of the wear of the polishing pad, the moving average of the average of the torque or current of said table rotating motor, and the moving average of the average of the torque or current of said top ring rotating motor.

7. The polishing apparatus according to claim 6, wherein said diagnostic device is configured to judge that the polishing pad has reached the end of its life if the amount of the wear of the polishing pad is more than a predetermined management value, the moving average of the average of the torque or current of said top ring rotating motor is more than a first set value, and the moving average of the average of the torque or current of said table rotating motor is less than a second set value.

8. The polishing apparatus according to claim 6, wherein said diagnostic device is configured to judge that the polishing pad has reached the end of its life if the amount of the wear of the polishing pad is more than a predetermined management value and a difference between the moving average of the average of the torque or current of said table rotating motor and the moving average of the average of the torque or current of said top ring rotating motor is not more than a preset value.

9. The polishing apparatus according to claim 6, wherein said diagnostic device is configured to judge that the polishing pad has reached the end of its life if the amount of the wear of the polishing pad is more than a predetermined management value and a difference between a rate of change in the moving average of the average of the torque or current of said top ring rotating motor and a rate of change in the moving average of the average of the torque or current of said table rotating motor is more than a preset value.

10. The polishing apparatus according to claim 1, further comprising:

a dresser configured to dress the polishing surface of the polishing pad, wherein said pad-height measuring device is configured to obtain plural measured values of the height of the polishing pad each time said dresser dresses the polishing pad, and said diagnostic device is configured to determine the height of the polishing pad from an average of the plural measured values and to determine the amount of wear of the polishing pad from a difference between the determined height of the polishing pad and an initial height of the polishing pad.

11. The polishing apparatus according to claim 10, wherein said diagnostic device is configured to calculate a moving average of the determined height of the polishing pad and to determine the amount of wear of the polishing pad from a difference between the moving average of the height of the polishing pad and the initial height of the polishing pad.

12. The polishing apparatus according to claim 10, wherein said pad-height measuring device is configured to indirectly measure the height of the polishing pad based on a vertical position of said dresser and to measure the height of the polishing pad while said dresser is dressing the polishing pad.

13. The polishing apparatus according to claim 12, wherein said diagnostic device is configured to remove measured values obtained during a predetermined dressing initial period and a predetermined dressing final period from the plural measured values to thereby obtain pad-height measured values that reflect the height of the polishing pad, and to determine the height of the polishing pad from an average of the pad-height measured values.

14. The polishing apparatus according to claim 1, wherein said diagnostic device is configured to judge a life of the polishing pad based on a combination of the amount of wear of the polishing pad, a decrease in the torque or current of said table rotating motor, and an increase in the torque or current of said top ring rotating motor.

15. A polishing apparatus comprising:

a polishing table for supporting a polishing pad;

a top ring configured to press a substrate against a polishing surface of the polishing pad;

a table rotating motor configured to rotate said polishing table about its own axis;

a top ring rotating motor configured to rotate said top ring about its own axis;

a dresser configured to dress the polishing surface of the polishing pad;

a pad-height measuring device configured to measure a height of the polishing pad; and a diagnostic device configured to monitor the height of the polishing pad, a torque or current of said table rotating motor, and a torque or current of said top ring rotating motor, wherein said diagnostic device is configured to (i) calculate an amount of wear of the polishing pad from the height of the polishing pad, (ii) calculate a cut rate of the polishing pad by dividing the amount of wear of the polishing pad by a total dressing time per predetermined number of substrates, (iii) diagnose a life of said dresser based on all of three factors, which are (1) a change in the cut rate of the polishing pad during a period in which a plurality of substrates have been polished, (2) a change in the torque or current of said table rotating motor during the period in which the plurality of substrates have been polished, and (3) a change in the torque or current of said top ring rotating motor during the period in which the plurality of substrates have been polished, and (iv) provide notification that said dresser should be replaced when the diagnosed life of said dresser has reached an end, wherein said diagnostic device is configured to calculate an average of the torque or current of said table rotating motor obtained each time one substrate is polished and an average of the torque or current of said top ring rotating motor obtained each time one substrate is polished and to diagnose the life of said dresser based on the cut rate of the polishing pad, the average of the torque or current of said table rotating motor, and the average of the torque or current of said top ring rotating motor, and wherein said diagnostic device is configured to judge the life of said dresser based on a combination of the cut rate of the polishing pad, and a point of time when the average of the current of said table rotating motor becomes more than the average of the current of said top ring rotating motor.

16. The polishing apparatus according to claim 15, wherein said diagnostic device is configured to judge that said dresser has reached the end of its life if the cut rate of the polishing pad is less than a predetermined management value, the average of the torque or current of said top ring rotating motor is more than a first set value, and the average of the torque or current of said table rotating motor is less than a second set value.

17. The polishing apparatus according to claim 15, wherein said diagnostic device is configured to judge that said dresser has reached the end of its life if the cut rate of the polishing pad is less than a predetermined management value and a difference between the average of the torque or current of said table rotating motor and the average of the torque or current of said top ring rotating motor is not more than a preset value.

18. The polishing apparatus according to claim 15, wherein said diagnostic device is configured to judge that said dresser has reached the end of its life if the cut rate of the polishing pad is less than a predetermined management value and a difference between a rate of change in the average of the torque or current of said top ring rotating motor and a rate of change in the average of the torque or current of said table rotating motor is more than a preset value.

19. The polishing apparatus according to claim 15, wherein said diagnostic device is configured to calculate the average of the torque or current of said table rotating motor when said polishing table is rotated at substantially a constant speed during polishing of the substrate and to calculate the average of the torque or current of said top ring rotating motor when said top ring is rotated at substantially a constant speed during polishing of the substrate.

20. The polishing apparatus according to claim 15, wherein said diagnostic device is configured to calculate a moving average of the average of the torque or current of said table rotating motor and a moving average of the average of the torque or current of said top ring rotating motor, and to diagnose the life of said dresser based on the cut rate of the polishing pad, the moving average of the average of the torque or current of said table rotating motor, and the moving average of the average of the torque or current of said top ring rotating motor.

21. The polishing apparatus according to claim 20, wherein said diagnostic device is configured to judge that said dresser has reached the end of its life if the cut rate of the polishing pad is less than a predetermined management value, the moving average of the average of the torque or current of said top ring rotating motor is more than a first set value, and the moving average of the average of the torque or current of said table rotating motor is less than a second set value.

22. The polishing apparatus according to claim 20, wherein said diagnostic device is configured to judge that said dresser has reached the end of its life if the cut rate of the polishing pad is less than a predetermined management value and a difference between the moving average of the average of the torque or current of said table rotating motor and the moving average of the average of the torque or current of said top ring rotating motor is not more than a preset value.

23. The polishing apparatus according to claim 20, wherein said diagnostic device is configured to judge that said dresser has reached the end of its life if the cut rate of the polishing pad is less than a predetermined management value and a difference between a rate of change in the moving average of the average of the torque or current of said top ring rotating motor and a rate of change in the moving average of the average of the torque or current of said table rotating motor is more than a preset value.

24. The polishing apparatus according to claim 15, wherein:

said pad-height measuring device is configured to obtain plural measured values of the height of the polishing pad each time said dresser dresses the polishing pad; and said diagnostic device is configured to determine the height of the polishing pad from an average of the plural measured values and to determine the amount of wear of the polishing pad from a difference between the determined height of the polishing pad and an initial height of the polishing pad.

25. The polishing apparatus according to claim 24, wherein said diagnostic device is configured to calculate a moving average of the determined height of the polishing pad and to determine the amount of wear of the polishing pad from a difference between the moving average of the height of the polishing pad and the initial height of the polishing pad.

26. The polishing apparatus according to claim 24, wherein said pad-height measuring device is configured to indirectly measure the height of the polishing pad based on a vertical position of said dresser and to measure the height of the polishing pad while said dresser is dressing the polishing pad.

27. The polishing apparatus according to claim 26, wherein said diagnostic device is configured to remove measured values obtained during a predetermined dressing initial period and a predetermined dressing final period from the plural measured values to thereby obtain pad-height measured values that reflect the height of the polishing pad, and to determine the height of the polishing pad from an average of the pad-height measured values.

28. The polishing apparatus according to claim 15, wherein said diagnostic device is configured to judge the life of said dresser based on a combination of the cut rate of the polishing pad, a decrease in the torque or current of said table rotating motor, and an increase in the torque or current of said top ring rotating motor.

* * * * *